US011822264B2

(12) United States Patent
Takano et al.

(10) Patent No.: US 11,822,264 B2
(45) Date of Patent: Nov. 21, 2023

(54) DEVELOPER DISCHARGING METHOD OF DEVELOPING DEVICE AND DEVELOPING DEVICE

(71) Applicant: CANON KABUSHIKI KAISHA, Tokyo (JP)

(72) Inventors: Hiroki Takano, Saitama (JP); Hisashi Tsukijima, Ibaraki (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 17/713,323

(22) Filed: Apr. 5, 2022

(65) Prior Publication Data

US 2022/0317590 A1 Oct. 6, 2022

(30) Foreign Application Priority Data

Apr. 6, 2021 (JP) ..... 2021-064899

(51) Int. Cl.
*G03G 15/08* (2006.01)

(52) U.S. Cl.
CPC ..... *G03G 15/087* (2013.01); *G03G 15/0844* (2013.01); *G03G 15/0881* (2013.01);
(Continued)

(58) Field of Classification Search
CPC ..... G03G 15/0891; G03G 15/0881; G03G 15/502; G03G 15/553; G03G 15/0893;
(Continued)

(56) References Cited

U.S. PATENT DOCUMENTS 5,436,703 A * 7/1995 DeYoung ..... G03G 15/0844 399/256
5,548,385 A * 8/1996 Takai ..... G03G 15/0853 399/62

(Continued)

FOREIGN PATENT DOCUMENTS

JP 2012-002980 A 1/2012
JP 2017-156488 A 9/2017

(Continued)

OTHER PUBLICATIONS

Hisashi Tsukijima et al., U.S. Appl. No. 17/711,179, filed Apr. 5, 2022.

*Primary Examiner* — Arlene Heredia
*Assistant Examiner* — Laura Roth
(74) *Attorney, Agent, or Firm* — VENABLE LLP

(57) ABSTRACT

A developing device includes a developer container including first and second chambers, first and second communication portions to permit the developer to communicate with the first and second chambers, first and second screws provided in the first and second chambers, respectively, and a developer discharging portion. The developer discharging portion is provided in a passage continuous with the first chamber and downstream of the first communication portion. In the developing device, a discharging method includes a step for inserting a shielding member into the second communication portion via an inserting opening of the developer container, and a step for discharging the developer from the developing device via the developer discharging portion, by rotating the first and second screws in a same direction as a direction of rotating during a developing operation in a state where the shielding member is inserted into the second communication portion.

6 Claims, 21 Drawing Sheets

(52) U.S. Cl.
CPC ..... *G03G 15/0891* (2013.01); *G03G 15/0896* (2013.01); *G03G 15/0893* (2013.01); *G03G 2215/0827* (2013.01); *G03G 2215/0872* (2013.01)

(58) Field of Classification Search
CPC ..... G03G 15/087; G03G 2215/0827; G03G 2215/0872; G03G 15/0844; G03G 15/0896; G03G 2215/0802; G03G 2215/0822; G03G 2215/0838
See application file for complete search history.

(56) References Cited

U.S. PATENT DOCUMENTS

2007/0098449 A1* 5/2007 Kadota ..... G03G 15/09 399/258
2007/0166079 A1* 7/2007 Ichikawa ..... G03G 21/105 399/254
2007/0274741 A1* 11/2007 Shiraishi ..... G03G 15/0893 399/254
2009/0214265 A1* 8/2009 Ikeda ..... G03G 15/0896 399/254
2011/0236074 A1* 9/2011 Maeda ..... G03G 15/0893 399/256
2012/0002983 A1* 1/2012 Kataoka ..... G03G 15/0879 399/258
2019/0129328 A1* 5/2019 Watanabe ..... G03G 15/0848

FOREIGN PATENT DOCUMENTS

JP 2018-063283 A 4/2018
JP 2020-095241 A 6/2020

* cited by examiner (a)

(b)

DEVELOPER DISCHARGING METHOD OF DEVELOPING DEVICE AND DEVELOPING DEVICE

FIELD OF THE INVENTION AND RELATED ART

The present invention relates to a developer discharge method for a developing device which develops an electrostatic latent image which is formed on an image bearing member by using a developer which includes toner and a carrier, and the developing device.

Since the developer deteriorates with use in the developing device, a constitution is proposed, in which only the developer is replaced while the developing device is not replaced, by discharging the deteriorated developer in the developing device and supplying a new developer (For example, Japanese Laid-Open Patent Application (JP-A) 2018-63283). In a case of a constitution described in JP-A 2018-63283, a first chamber for supplying the developer to a developing sleeve and a second chamber which forms a circulation passage of the developer with the first chamber are arranged vertically. Thus, in a way of conveying the developer by conveying screws which are arranged in the first chamber and the second chamber respectively, it is possible to move the developer to the second chamber by gravity and further collect the developer in a collecting container which is connected to the second chamber.

In recent years, from a perspective of a resource reutilization and an environmental protection, it is required to reuse a used developing device. Here, in a case of collecting the used developing device, unlike at a time of shipment, it may be transported without sealing the developer, so the developer may scatter during transportation when a large amount of developer is accommodated in the used developing device. As a result, in a case of reuse of the developing device, a cleaning work becomes more complicated and a reproduction cost may be increased.

Consequently, as a constitution which is described in JP-A 2018-63283, it is conceivable that the developer is discharged by driving the conveying screw before transporting the used developing device. In the case of the constitution described in JP-A 2018-63283, the first chamber and the second chamber are arranged vertically, so it is easy to discharge the developer by gravity.

On the other hand, as a developing device, there is a constitution in which the first chamber and the second chamber are arranged adjacent to each other in a horizontal direction or a diagonal direction, however, it is impossible to properly discharge the developer by simply driving the conveying screw in such a constitution. That is, in a case that a first conveying member which conveys the developer in the first chamber and a second conveying member which conveys the developer in the second chamber are constituted so at least a part of them overlap when viewed from a horizontal direction, it is impossible to discharge a sufficient amount of the developer by simply driving the first conveying member and the second conveying member.

SUMMARY OF THE INVENTION

In response to the above issue, a principal object of the present invention is to provide a developer discharging method of a developing device.

Another object of the present invention is to provide a developer discharging method of a developing device including, a developer carrying member configured to carry and feed a developer, containing toner and a carrier, to a developing position, a developer container including a first chamber configured to accommodate the developer to be supplied to said developer carrying member, and a second chamber partitioned from said first chamber by a partition wall, the developer being circulated between said first chamber and said second chamber, a first communication portion configured to permit the developer to communicate from said first chamber to said second chamber, a second communication portion configured to permit the developer to communicate from said second chamber to said first chamber, a first feeding screw provided in said first chamber and configured to feed the developer with respect to a first direction from said second communication portion toward said first communication portion, a second feeding screw provided in said second chamber and configured to feed the developer with respect to a second direction from said first communication portion toward said second communication portion, and a developer discharging portion provided in a passage continuous with said second chamber of a downstream side of said second communication portion with respect to the second direction and configured to discharge the developer from said developing device, said developer discharging method comprising: an inserting step for inserting a shield member into said second communication portion via an inserting opening of said developer container, said shield member causing said second communication portion from an opening state for opening said second communication portion to a shielding state for shielding said second communication portion; and a discharging step, by rotatably driving said first feeding screw in a direction same as a direction of rotatably driving said first feeding screw during a developing operation of developing an electrostatic image formed on an image bearing member in a state in which said shielding member is inserted into said second communication portion in said inserting step, and by rotatably driving said second feeding screw in a direction same as a direction of rotatably driving said second feeding screw during the developing operation in the state in which said shielding member is inserted into said second communication portion in said inserting step, for discharging the developer from said developing device via said developer discharging portion.

Another object of the present invention is to provide a developer discharging method of a developing device including, a developer carrying member configured to carry and feed a developer, containing toner and a carrier, to a developing position, a developer container including a first chamber configured to accommodate the developer to be supplied to said developer carrying member, and a second chamber partitioned from said first chamber by a partition wall, the developer being circulated between said first chamber and said second chamber, a first communication portion configured to permit the developer to communicate from said first chamber to said second chamber, a second communication portion configured to permit the developer to communicate from said second chamber to said first chamber, a first feeding screw provided in said first chamber and configured to feed the developer with respect to a first direction from said second communication portion toward said first communication portion, a second feeding screw provided in said second chamber and configured to feed the developer with respect to a second direction from said first communication portion toward said second communication portion, and a developer discharging portion provided in a passage continuous with said first chamber of a downstream side of said first communication portion with respect to the first direction and configured to discharge the developer from said developing device, said developer discharging method comprising: an inserting step for inserting a shield member into said first communication portion via an inserting opening of said developer container, said shield member causing said first communication portion from an opening state for opening said first communication portion to a shielding state for shielding said first communication portion; and a discharging step, by rotatably driving said first feeding screw in a direction same as a direction of rotatably driving said first feeding screw during a developing operation of developing an electrostatic image formed on an image bearing member in a state in which said shielding member is inserted into said first communication portion in said inserting step, and by rotatably driving said second feeding screw in a direction same as a direction of rotatably driving said second feeding screw during the developing operation in the state in which said shielding member is inserted into said first communication portion in said inserting step, for discharging the developer from said developing device via said developer discharging portion.

Another object of the present invention is to provide a developing device comprising a developer carrying member configured to carry and feed a developer, containing toner and a carrier, to a developing position; a developer container including a first chamber configured to accommodate the developer to be supplied to said developer carrying member, and a second chamber partitioned from said first chamber by a partition wall, the developer being circulated between said first chamber and said second chamber; a first communication portion configured to permit the developer to communicate from said first chamber to said second chamber; a second communication portion configured to permit the developer to communicate from said second chamber to said first chamber; a first feeding screw provided in said first chamber and configured to feed the developer with respect to a first direction from said second communication portion toward said first communication portion; a second feeding screw provided in said second chamber and configured to feed the developer with respect to a second direction from said first communication portion toward said second communication portion; and a developer discharging portion provided in a passage continuous with said second chamber of a downstream side of said second communication portion with respect to the second direction and configured to discharge the developer from said developing device, wherein said developer container is provided with an inserting opening into which a shield member is to be inserted, said shield member causing said second communication portion from an opening state for opening said second communication portion to a shielding state for shielding said second communication portion.

Another object of the present invention is providing a developing device comprising a developer carrying member configured to carry and feed a developer, containing toner and a carrier, to a developing position; a developer container including a first chamber configured to accommodate the developer to be supplied to said developer carrying member, and a second chamber partitioned from said first chamber by a partition wall, the developer being circulated between said first chamber and said second chamber; a first communication portion configured to permit the developer to communicate from said first chamber to said second chamber; a second communication portion configured to permit the developer to communicate from said second chamber to said first chamber; a first feeding screw provided in said first chamber and configured to feed the developer with respect to a first direction from said second communication portion toward said first communication portion; a second feeding screw provided in said second chamber and configured to feed the developer with respect to a second direction from said first communication portion toward said second communication portion; and a developer discharging portion provided in a passage continuous with said first chamber of a downstream side of said first communication portion with respect to the first direction and configured to discharge the developer from said developing device, wherein said developer container is provided with an inserting opening into which a shield member is to be inserted, said shielding member causing said first communication portion from an opening state for opening said first communication portion to a shielding state for shielding said first communication portion.

Further features of the present invention will become apparent from the following description of exemplary embodiments with reference to the attached drawings.

Figure 18:
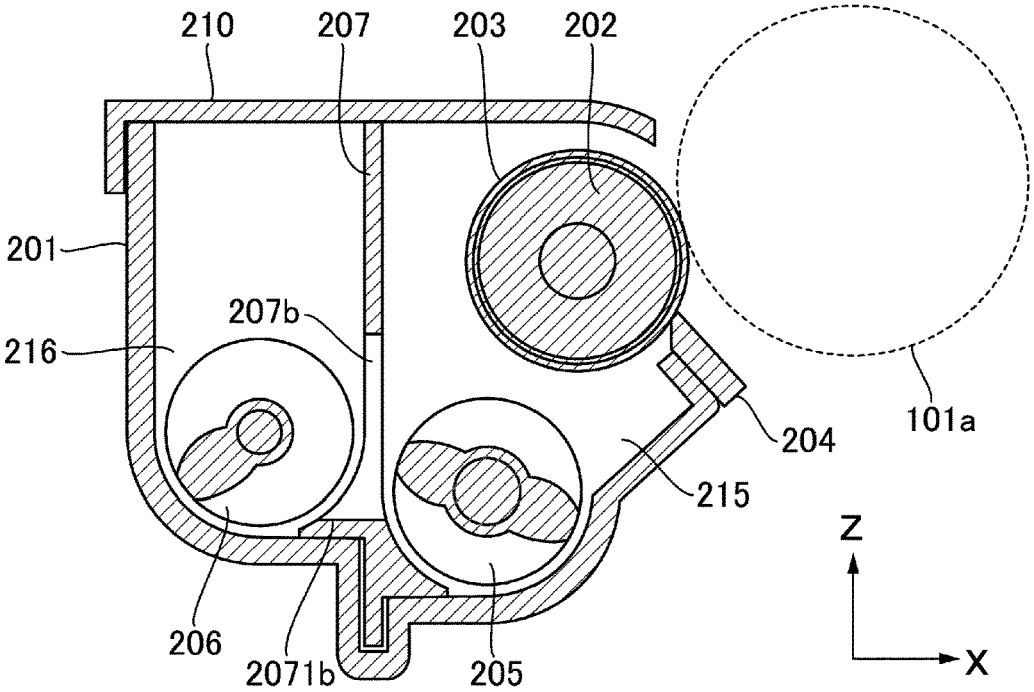
Figure 18:
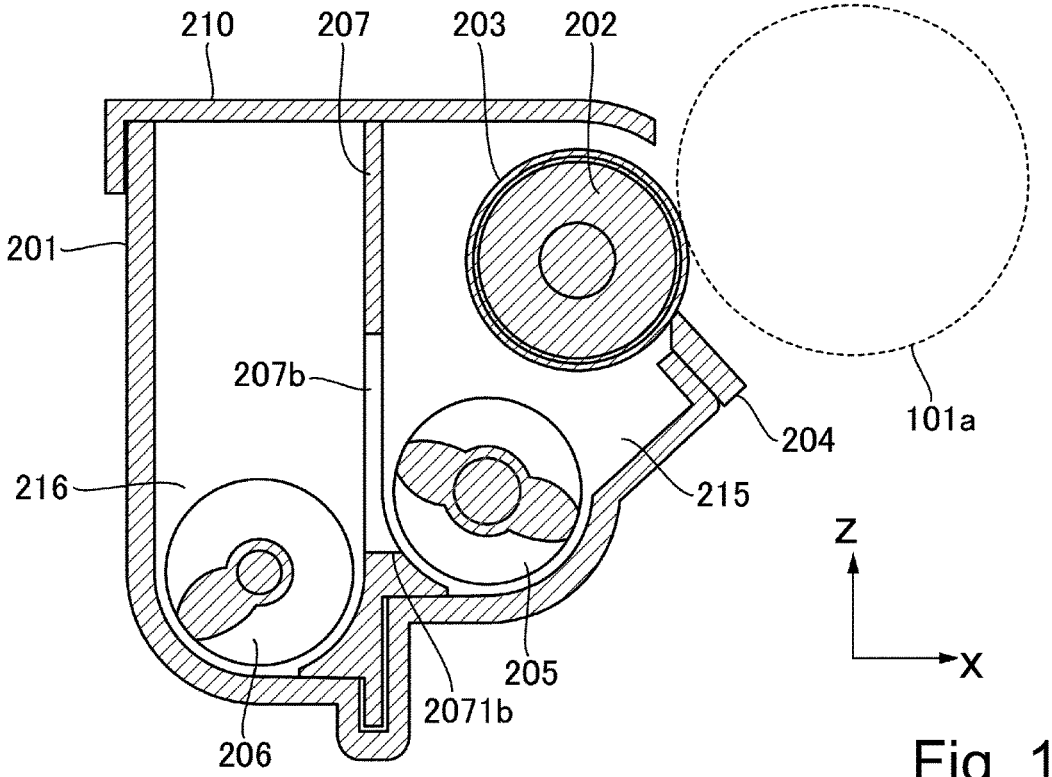

Part (a) of FIG. 18 is a schematic cross sectional view of the developing device according to a first example of a fourth embodiment, and part (b) of FIG. 18 is a schematic cross sectional view of the developing device according to a second example of a fourth embodiment.

Figure 19:
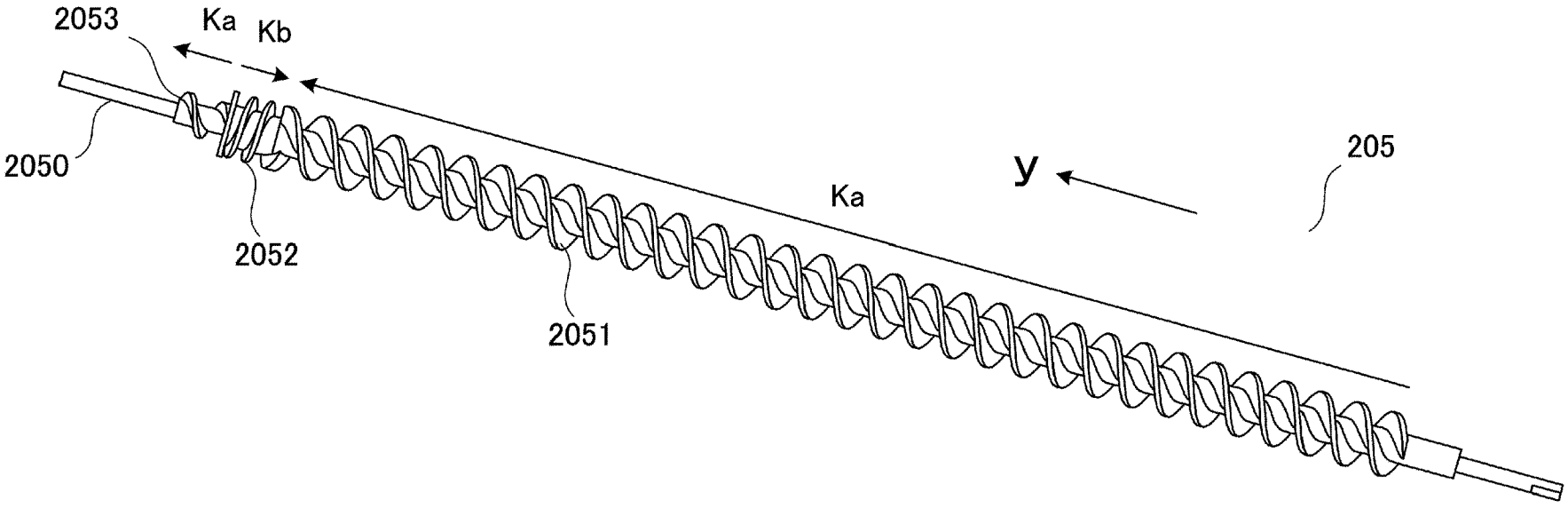

FIG. 19 is a perspective view of a conveying screw according to a fifth embodiment.

Figure 20:
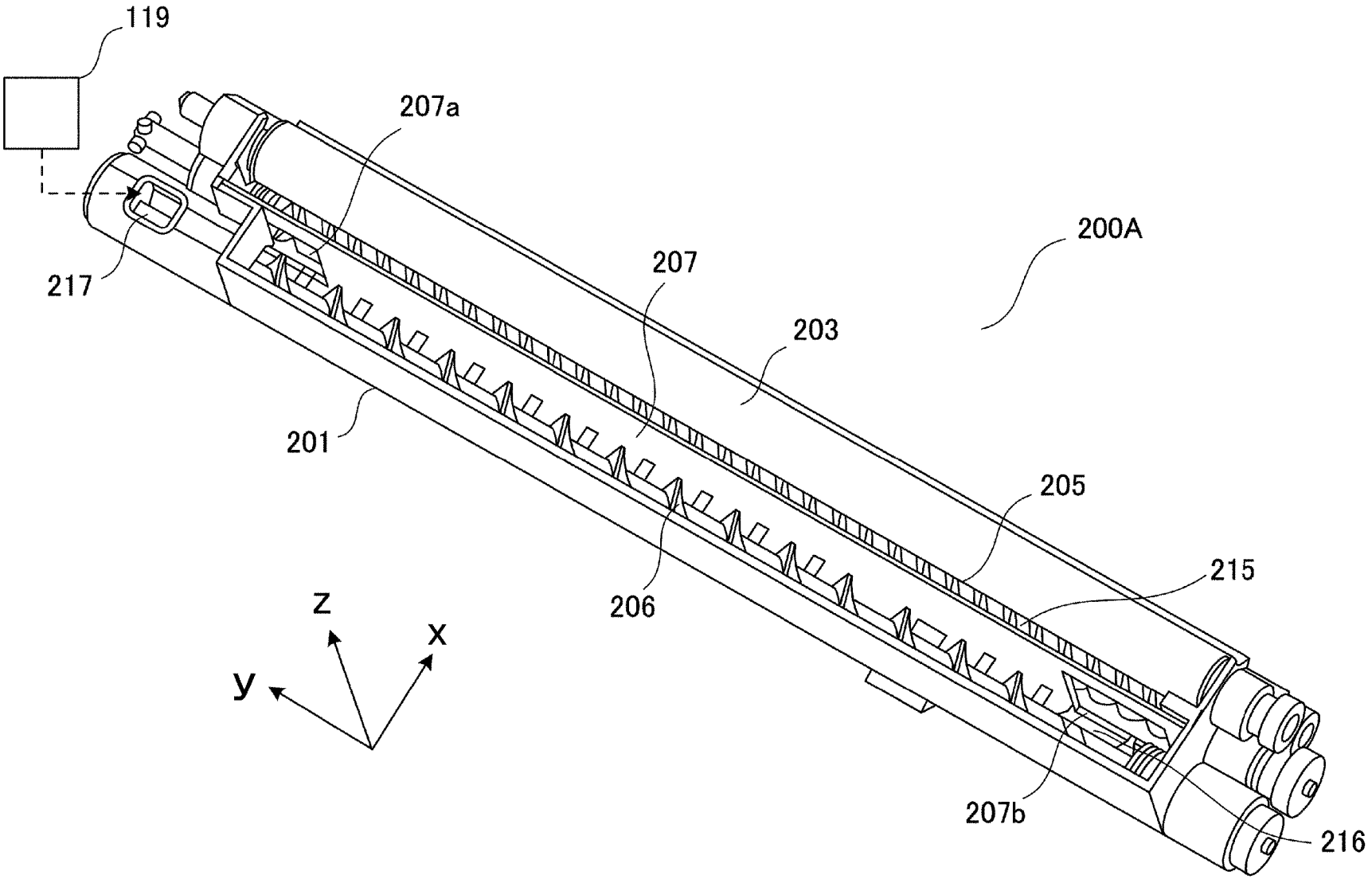

FIG. 20 is a perspective view showing the developing device while a top cover is removed according to a sixth embodiment.

Figure 21:
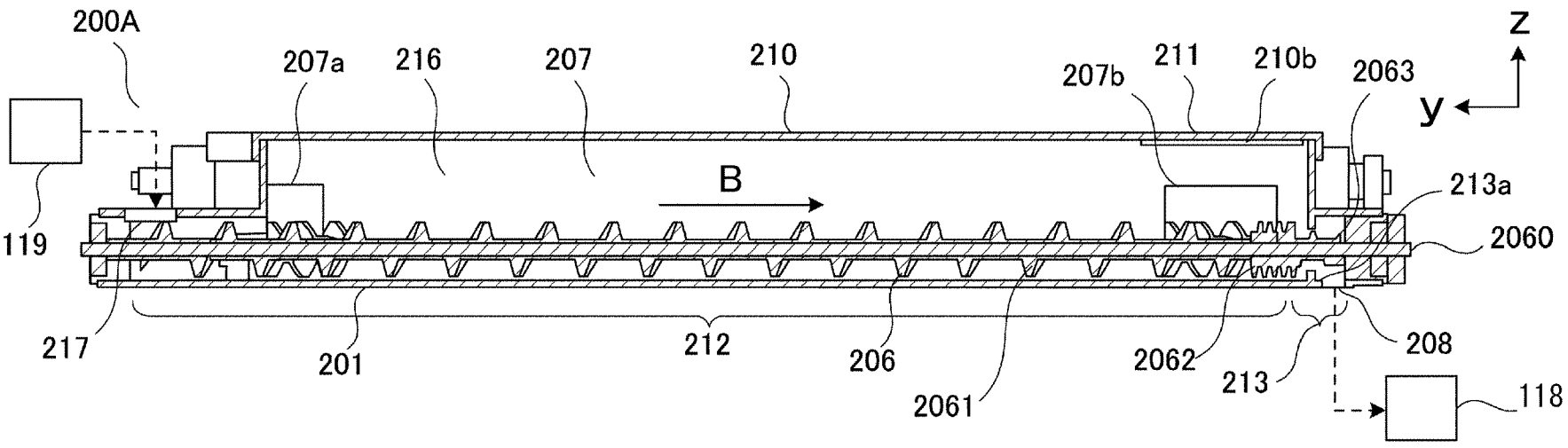

FIG. 21 is a schematic longitudinal sectional view of the developing device taken in a vertical direction according to the sixth embodiment.

Figure 22:
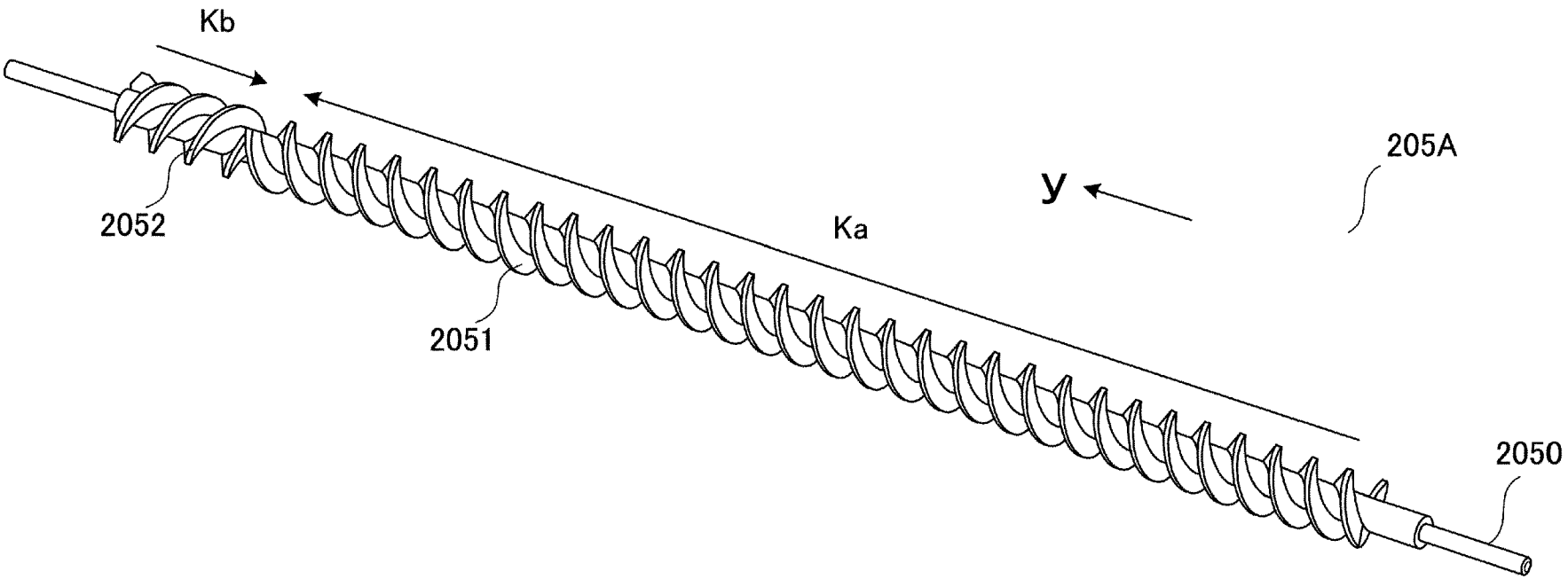

FIG. 22 is a perspective view of a conveying screw according to the sixth embodiment.

DESCRIPTION OF THE EMBODIMENTS

First Embodiment

A first embodiment will be described by using FIG. 1 through FIG. 14. First of all, a schematic structure of an image forming apparatus is described by using FIG. 1.

Figure 1:
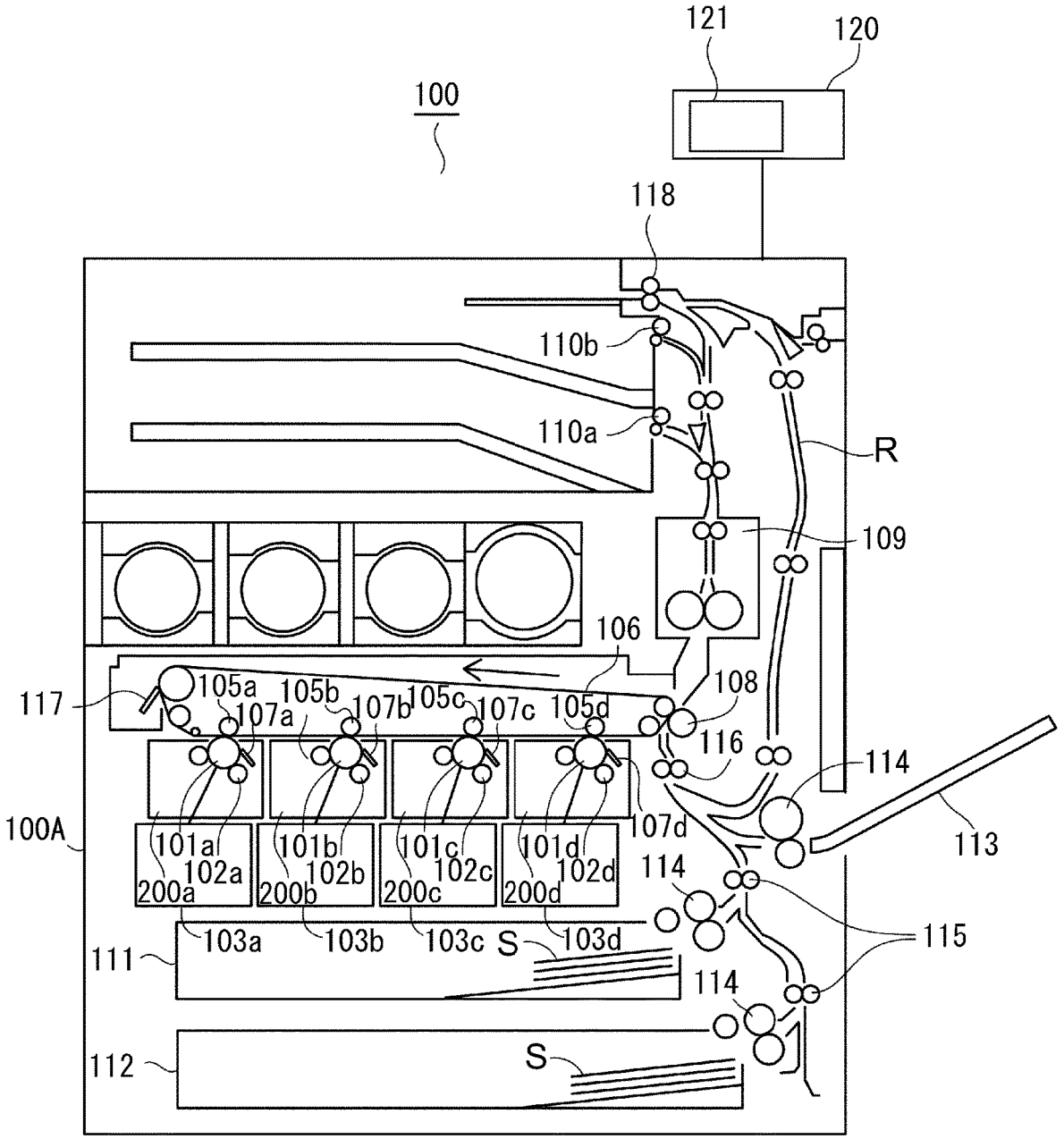
FIG. 1 is a schematic structure sectional view of an image forming apparatus according to a first embodiment of the present invention.

FIG. 1 is a sectional view showing an overview of a tandem type color digital printer of an intermediary transfer method which includes four image forming portions as the image forming apparatus of the embodiment. The image forming apparatus 100 includes image forming portions from first through fourth as a plurality of image forming portions. Each of the image forming portions forms a color image of yellow (Y), magenta (M), cyan (C), and black (K), respectively. In the embodiment, constitutions and operations of the respective image forming portions are substantially the same, except that color of toner used is different.

Four photosensitive drums 101*a*, 101*b*, 101*c*, and 101*d* are cylindrical photosensitive members respectively which are rotated and driven respectively in a clockwise direction in FIG. 1. And each surface of photosensitive drums from 101*a* to 101*d* is charged to a uniform charge by charging rollers 102*a*, 102*b*, 102*c*, and 102*d*, respectively. Next, each image signal of yellow, magenta, cyan, and black is input to laser scanners 103*a*, 103*b*, 103*c*, and 103*d* as exposure means, respectively. And the laser scanners from 103*a* to 103*d* irradiate surfaces of the photosensitive drums from 101*a* to 101*d* respectively with laser light according to the image signals, and neutralize electric charges and form electrostatic latent images.

The electrostatic latent image which is formed on each photosensitive drum from 101*a* to 101*d* is developed by a developer in each developing device 200*a*, 200*b*, 200*c*, and 200*d*. That is, each of the developing devices from 200*a* to 200*d* attaches toner charged with a same polarity as each of the photosensitive drums from 101*a* to 101*d* and visualizes the electrostatic latent image as yellow, magenta, cyan, and black toner image (reverse developing).

Each of the toner images which are developed on the photosensitive drums from 101*a* to 101*d* is primarily transferred to an intermediary transfer belt 106 as an intermediary transfer member which is rotated and driven in a counter-clockwise direction in FIG. 1, sequentially by primary transfer rollers 105*a*, 105*b*, 105*c*, and 105*d*. And since each of the toner images is superimposed on the intermediary transfer belt 106, a full color toner image is formed. At this time, a primary transfer voltage (primary transfer bias), which is a DC voltage of an opposite polarity to a toner charge polarity at a time of development, is applied to each of the primary transfer rollers from 105*a* to 105*d*. Further, a transfer residual toner, which is not transferred and remains on each of the photosensitive drums from 101*a* to 101*d*, is removed and collected by each of drum cleaners 107*a*, 107*b*, 107*c*, and 107*d*.

On the other hand, a recording material P such as paper, fed from any of a cassette 111, a cassette 112 or a manual feed tray 113 which accommodate recording materials, is fed to a registration roller 116 by a feeding roller 114 or a conveying roller 116. And, after a leading end of the recording material P urges the stopped registration roller 116 and forms a loop, the registration roller 116 starts rotating in synchronization with the toner image on the intermediary transfer belt 106. And the recording material P is fed to a secondary transfer portion where an outer secondary transfer roller 108 urges the intermediary transfer belt 106. Incidentally, as a recording material, a sheet such as a paper and a plastic sheet is included.

The toner image on the intermediary transfer belt 106 is secondarily transferred to the recording material P by the outer secondary transfer roller 108 in the secondary transfer portion. At this time, a secondary transfer voltage (secondary transfer bias), which is a voltage of opposite polarity to a toner charge polarity at a time of development, is applied to the outer secondary transfer roller 108. Then, the toner image, which is transferred to the recording material P, is fixed to the recording material P by heat and pressure of a fixing device 109, and is discharged from a discharging portion 110*a* or a discharging portion 110*b* to an outside of the apparatus. Further, a transfer residual toner on the intermediary transfer belt 106, which is not transferred and remains in the secondary transfer portion, is removed and collected by an intermediary transfer belt cleaner 117.

Incidentally, the image forming apparatus 100 includes an operation portion 120 which is possible to operate the image forming apparatus 100, such as starting and stopping an image forming operation of the image forming apparatus 100 and various settings. The operation portion 120 is possible to display various information of the image forming apparatus 100. In the embodiment, the operation portion 120 includes a touch panel 121 as a display portion, displays information on the touch panel 121, and furthermore is possible to operate various settings and operation of the apparatus by touch operation.

[Developing Device]

Figure 2:
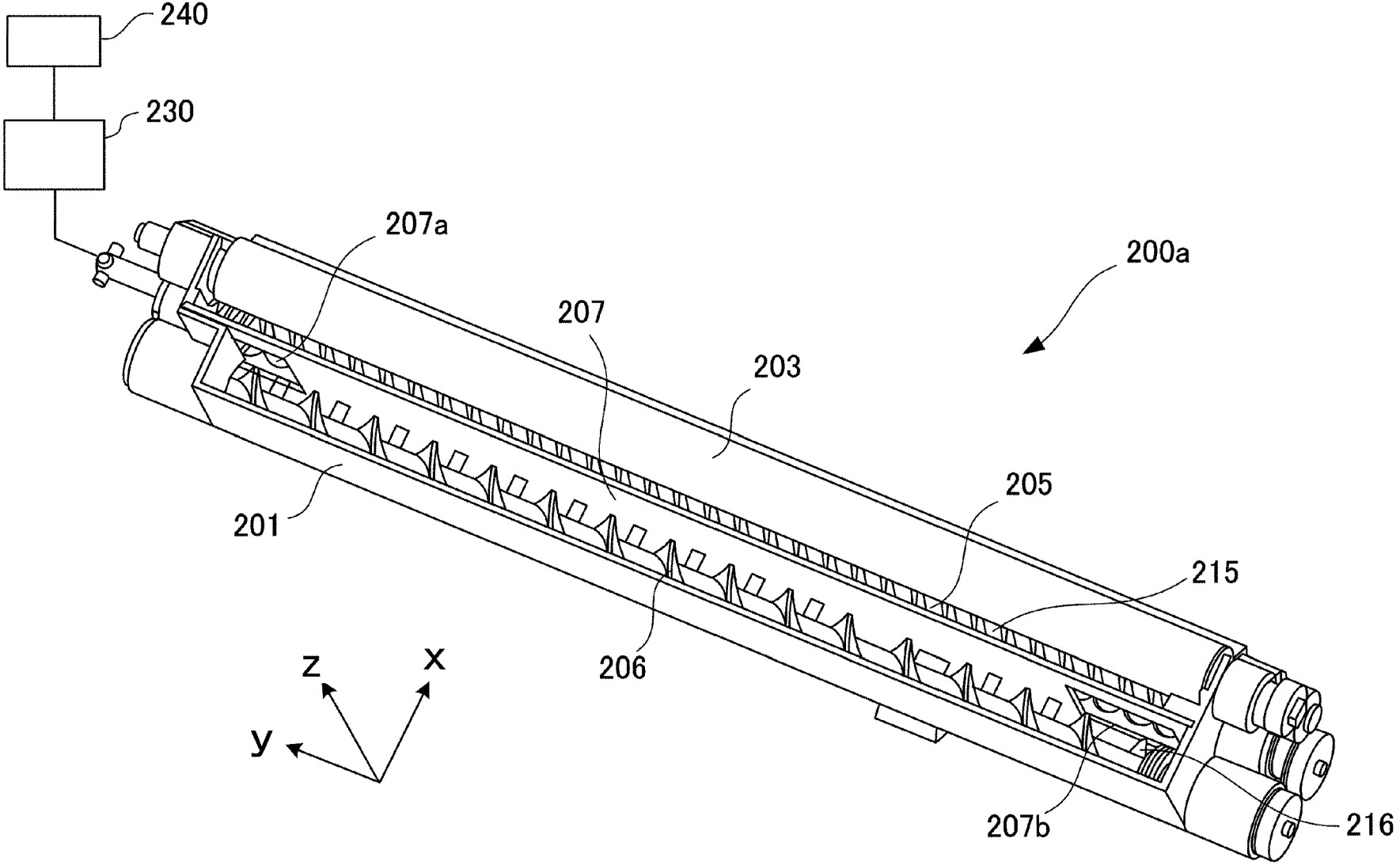
FIG. 2 is a perspective view showing a developing device while a top cover is removed according to the first embodiment.
Figure 3:
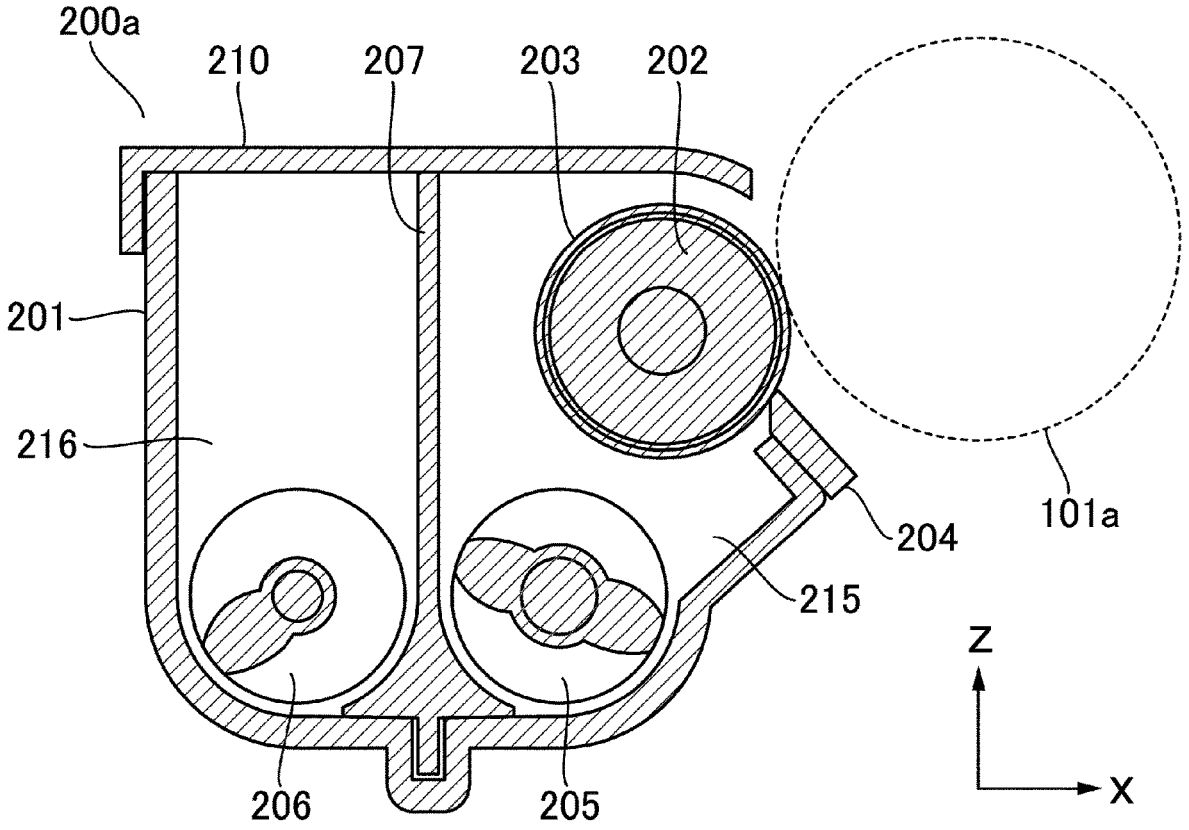
FIG. 3 is a schematic cross sectional view of the developing device according to the first embodiment.

Next, developing devices from 200*a* through 200*d* of the embodiment will be described by using FIG. 2 through FIG. 5. Each of developing devices from 200*a* to 200*d* is dismountable from a main assembly 100A of the image forming apparatus 100 in FIG. 1 so that each of them is possible to replace. Since a constitution of each of the developing devices from 200*a* to 200*d* is the same, the developing device 200*a* will be described as a representative. FIG. 2 is a perspective view showing of an inside of the developing device 200*a*, and FIG. 3 is a sectional view at a substantially center position in a longitudinal direction of the developing device 200*a*. Incidentally, the longitudinal direction of the developing device 200*a* is a direction which is substantially parallel to a rotational axis direction of the photosensitive drum 101*a* and a developing sleeve 203 as will be described below.

The developing device 200*a* of the embodiment utilizes a two-component developing method which uses toner (non-magnetic) and a carrier (magnetic) as a developer. The two-component developing method includes advantages such as a stability of an image quality and a durability of an apparatus, compared to other developing methods which are currently proposed. The developing device 200*a* accommodates the two-component developer in the developer container 201, and an amount of the developer is approximately 250 g in the embodiment. Further, a mixing ratio of toner and carrier is approximately 1:9 by weight. However, the amount of developer and the mixing ratio of toner and carrier should be adjusted appropriately depending on a constitution of the developing device 200*a*, a charge amount of the toner, a particle diameter of the carrier, and a constitution of the image forming apparatus 100, and should not be limited to the number.

As shown in FIG. 3, a top of the developer container 201 is covered by a developing top cover 210 as a cover and the developer container 201 opens in a developing area which opposes the photosensitive drum 101*a*. Incidentally, in order to show an inside of the developing device 200*a* in FIG. 2, the developing top cover 210 is not shown. The developing sleeve 203 as a developer carrying member is rotatably provided, inside which a magnet 202 is non rotatably arranged, so as to be partially exposed to the opening portion of the developer container 201.

The developing sleeve 203 is formed with nonmagnetic material, and while the developing sleeve 203 rotates during a developing operation, a two-component developer inside the developer container 201 is carried in a layered form and is conveyed in a direction toward a developer regulating member (blade for example) 204. The developer regulating member 204 is arranged opposing a surface of the developing sleeve 203 by a predetermined gap. The developer, which is carried by the developing sleeve 203, is regulated in quantity by the developer regulating member 204 and becomes a layer of a predetermined thickness, and then conveyed to the developing area. And the developer is supplied to the photosensitive drum 101*a* in the developing area, and an electrostatic latent image which is formed on the photosensitive drum 10 is developed. After developing the electrostatic latent image, the developer enters inside the developer container 201 according to a rotation of the developing sleeve 203, is removed from a surface of the developing sleeve 203 at a scraping position and is collected into the developer container 201.

A space inside the developer container 201 is divided into two parts by a partition wall 207, which are a developing chamber 215 as a first chamber which is possible to accommodate the developing sleeve 203 and the developer, and a mixing chamber 216 as a second chamber which is possible to accommodate the developer. That is, the developing chamber 215 accommodates the developer to supply to the developing sleeve 203. The mixing chamber 216 forms a circulating passage of the developer between the mixing chamber 216 and the developing chamber 215. The partition wall 207 divides into the developing chamber 215 and the mixing chamber 216.

In the embodiment, the developing chamber 215 and the mixing chamber 216 are arranged in a substantially horizontal direction adjacent to each other, and the partition wall 207 is arranged between them in a substantially vertical direction.

In the developing chamber 215, a conveying screw 205 is arranged as a first conveying member, and in the mixing chamber 216, the mixing screw 206 is arranged as a second conveying member. The developer in the developing chamber 215 (first chamber) is conveyed by the conveying screw 205 in a direction of an arrow A in FIG. 4 as a first direction, and the developer in the mixing chamber 216 (second chamber) is conveyed by the mixing screw 206 in a direction of an arrow B in FIG. 4 as a second direction which is opposite to the first direction. Further, the conveying screw 205 is arranged below the developing sleeve 203, and the conveying screw 205 and the mixing screw 206 are arranged at a position in which both of them are at least partially overlapped when they are viewed from a horizontal direction. In the embodiment, the conveying screw 205 is arranged below the developing sleeve 203, and the conveying screw 205 and the mixing screw 206 are arranged adjacent to each other in a substantially horizontal direction at a same height, and are arranged substantially parallel, and are conveying and mixing the developer in an opposite direction to each other.

Figure 4:
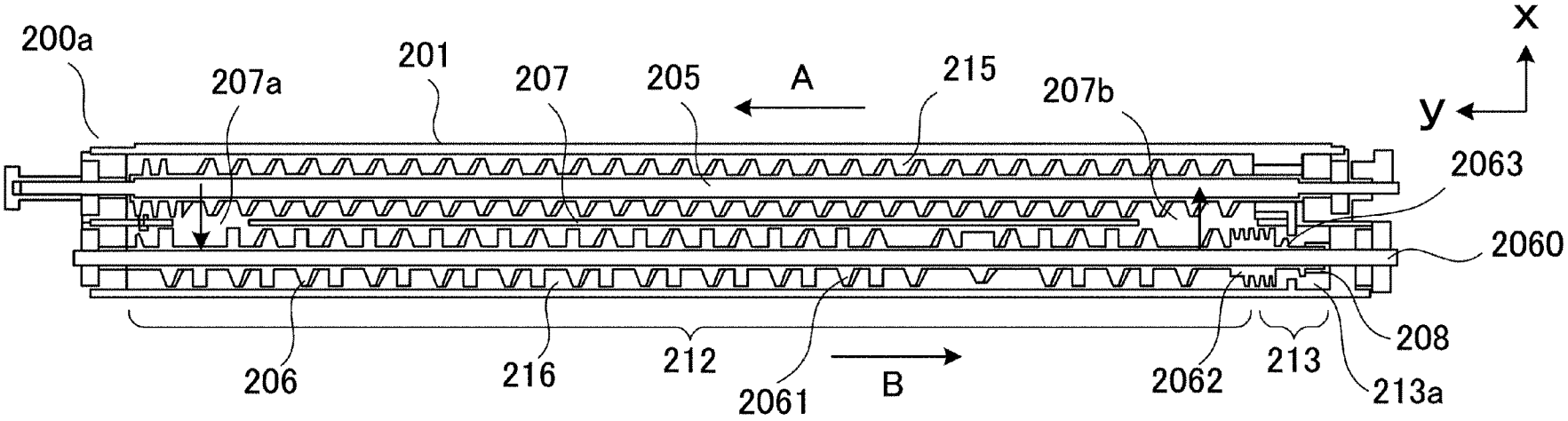
FIG. 4 is a schematic longitudinal sectional view of the developing device taken in a horizontal direction according to the first embodiment.
Figure 5:
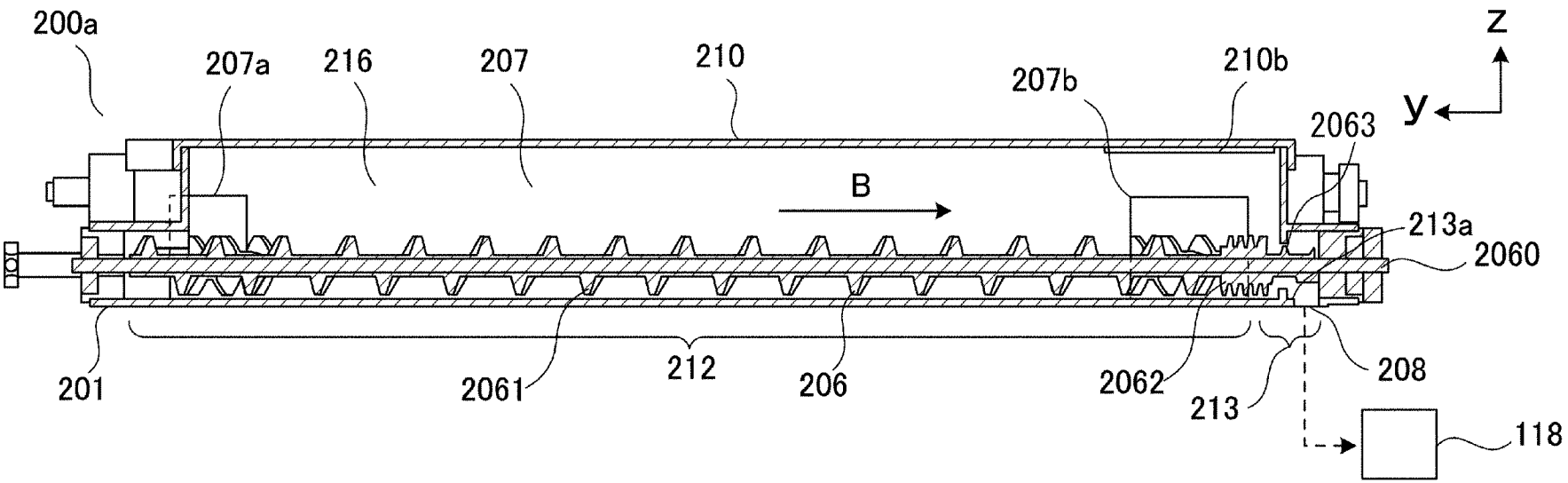
FIG. 5 is a schematic longitudinal sectional view of the developing device taken in a vertical direction according to the first embodiment.

Here, FIG. 4 is a sectional view of the developing device 200 which is cut perpendicular to the z-axis along a rotational axis of the mixing screw 206, and FIG. 5 is a sectional view of the developing device 200 taken perpendicular to x-axis along the rotational axis of the mixing screw 206.

As shown in FIG. 4 and FIG. 5, in the partition wall 207 which is provided between the conveying screw 205 and the mixing screw 206, a first opening portion 207*a* and a second opening portion 207*b* are formed so as to deliver the developer between the developing chamber 215 and the mixing chamber 216 and circulate smoothly. The first opening portion 207*a* is formed so as to connect the developing chamber 215 with the mixing chamber 216 in a downstream side of a developer conveying direction of the conveying screw 205 (direction of arrow A). The second opening portion 207*b* is formed so as to connect the developing chamber 215 with the mixing chamber 216 in a downstream side (downstream side with respect to second direction) of the mixing screw 206 with respect to a developer conveying direction (direction of arrow B).

The first opening portion 207*a* and the second opening portion 207*b* form a circulating passage which circulates the developer by connecting the developing chamber 215 with the mixing chamber 216. The conveying screw 205 and the mixing screw 206 mix the developer in the developer container 201, and convey and circulate the developer in the developer container 201. Specifically, the first opening portion 207*a* is an opening portion to deliver the developer from the developing chamber 215 to the mixing chamber 216. The second opening portion 207*b* is formed in a downstream side of the developer conveying direction of the mixing screw 206 than the first opening portion 207*a* and is an opening portion to deliver the developer from the mixing chamber 216 to the developing chamber 215.

The developing sleeve 203, the conveying screw 205, and the mixing screw 206 described above are driven by a motor 230 as a driving source (developing drive means). Specifically, the motor 230 is provided in a side of the main assembly 100A of the image forming apparatus 100, and when the developing device 200*a* is mounted on the main assembly 100A, the motor 230 is connected to, for example, an end portion of the conveying screw 205 in a side of the developing device 200*a* via a coupling. And by driving the motor 230, the developing sleeve 203, the conveying screw 205 and the mixing screw 206 are rotationally driven. That is, a coupling which is connected to the motor 230 is provided at one end portion with respect to a direction of a rotational axis of the conveying screw 205, and a gear train for a driving transmission to the mixing screw 206 and the developing sleeve 203 at the other end portion. And a driving force of the motor 230 is input to one end portion of the conveying screw 205, and the driving force is transmitted to the developing sleeve 203 and the mixing screw 206 via the conveying screw 205 and the gear train. However, the constitution of the driving transmission is not limited to this, and it may be constituted that the driving force is input from the motor 230 to the developing sleeve 203 and the mixing screw 206, for example. In any case, the motor 230 is possible to drive the developing sleeve 203, the conveying screw 205, and the mixing screw 206.

The motor 230 and the developing device 200*a* are controlled by a control portion 240. The control portion 240 also controls an entire image forming apparatus 100 and includes a CPU (Central Processing Unit), a ROM (Read Only Memory), and a RAM (Random Access Memory). The CPU controls each of portions, while reading a program corresponding to a control procedure which is stored in the ROM. Further, the RAM stores working data and input data, and the CPU controls by referring to data stored in the RAM based on the program described above, etc.

In the developing device 200*a* which is constituted as described above, the developer is provided from the developing chamber 215 to the developing sleeve 203, and the developer, after developing the electrostatic latent image on the photosensitive drum 101*a*, is collected in the developing chamber 215. And the developer is mixed by circulating conveyance of the developer between the developing chamber 215 and the mixing chamber 216, and the developer is provided from the developing chamber 215 to the developing sleeve 203 again.

[Constitution of Discharging Developer]

In the developing device, in a case that the same developer is continuously mixed over a long period of time, the developer deteriorates. For this reason, the developer is regularly replaced in a case that the image forming apparatus is used for a long period of time. In this case, from a viewpoint of a resource recycling and an environmental protection, it is required to reuse the used developing device.

In a case of reusing the used developing device, the used developing device is dismounted from the image forming apparatus and packed with a packing material for transportation, however, it is desirable to remove a sufficient amount of the developer (for example, approximately 75% in volume) which is still accommodated in the developer container before the transportation. This is because, when the used developing device, in which the developer is still accommodated, arrives at a recycling factory, the developer may be spilled in the packaging material during transportation and the used developing device may be covered in the developer. Further, it is easier to leak the developer in a case that the packaging material itself, which encloses the used developing device, is transported in an upside down state.

In a case that the used developing device is covered in the developer, when the used developing device is reused, cleaning workload, such as using a vacuum cleaner to suck up a large amount of the developer which is adhered to the used developing device, is enormous at the recycling factory and this leads to increase a cost of a reused product. Thus, in the embodiment, it is constituted that it is possible to discharge the developer from the used developing device.

As shown in FIG. 5, in the developing device 200*a* of the embodiment, a discharging passage 213, which discharges the developer, is provided in continuity with a conveying passage 212 (part of circulating passage) of the developer in which the conveying screw 205 is provided, in an upstream side with respect to the developer conveying direction of the conveying screw 205. Further, on a bottom surface 213*a* of the discharging passage 213, a developer discharging port 208 is provided. That is, the developer container 201 includes the discharging port 208 which is arranged outside the circulating passage and discharges the developer. In particular, in the embodiment, the discharging port 208 is arranged in a downstream side of the mixing screw 206 (downstream side of second direction) with respect to the developer conveying direction than the second opening portion 207*b* of the mixing chamber 216.

Figure 6:
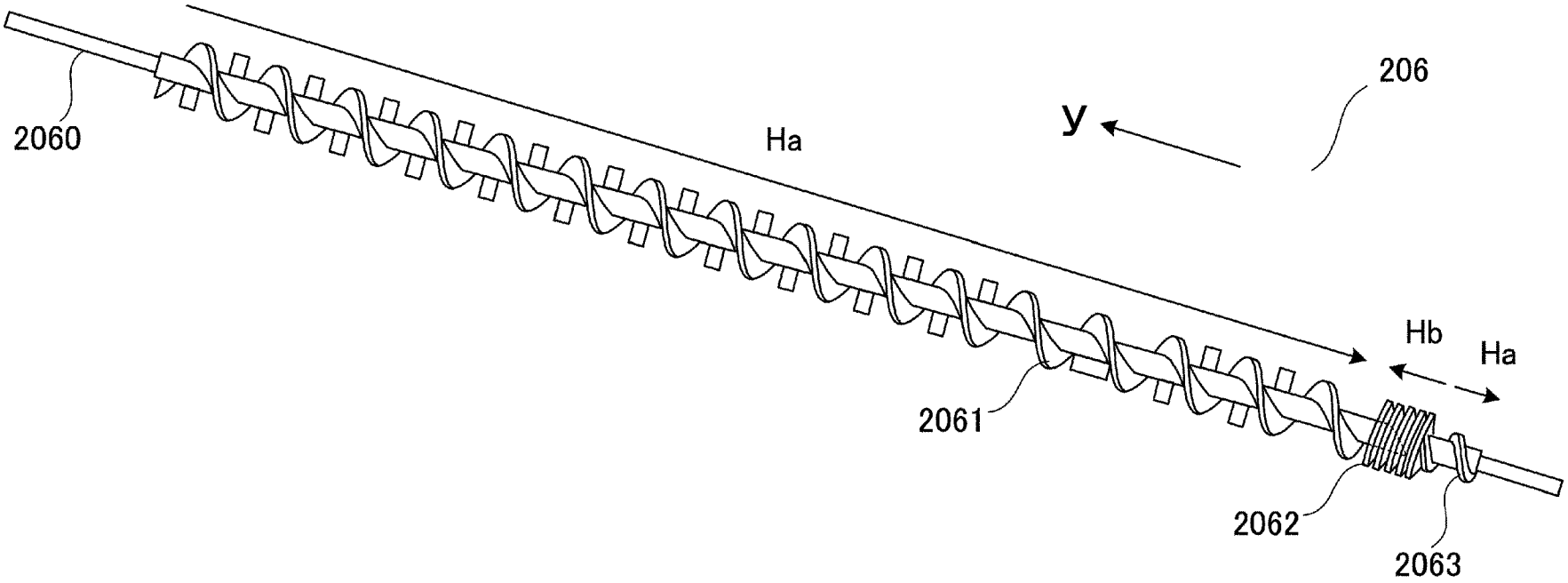
FIG. 6 is a perspective view of a mixing screw according to the first embodiment.

As shown in the perspective view in FIG. 6, the mixing screw 206 is provided with a returning blade portion 2062 as a reverse conveying portion, which possess a conveying force which is an opposite direction (direction of arrow Hb) to the developer conveying direction (direction of arrow Ha), in a downstream side with respect to the developer conveying direction. That is, the mixing screw 206 is provided with a conveying blade portion 2061 which possesses a conveying force in the developer conveying direction (direction of arrow Ha). In a downstream side of the conveying blade portion 2061 with respect to the developer conveying direction, a returning blade portion 2062, which possess a conveying force which is an opposite direction to the direction of the arrow Ha (direction of arrow Hb) and whose pitch is smaller than the conveying blade portion 2061, is provided. As shown in FIG. 5, the returning blade portion 2062 is arranged in a downstream side than an upstream end of the second opening portion 207*b* and in an upstream side than the discharging port 208 with respect to the developer conveying direction of the mixing screw 206 (direction of arrow Ha). And the developer, which is conveyed by the conveying blade portion 2061 of the mixing screw 206, is conveyed in an opposite direction (direction of arrow Hb) to the developer conveying direction (direction of arrow Ha) of the mixing screw 206.

Further, a discharging blade portion 2063, whose conveying force is in a same direction as the arrow Ha, is provided in the downstream side of the mixing screw 206 with respect to the developer conveying (arrow Ha) direction than the returning blade portion 2062. And a rotational axis 2060 of the mixing screw 206 is rotatably provided over the conveying passage 212 and the discharging passage 213, and rotates integrally the returning blade portion 2062 and the discharging blade portion 2063.

During the developing operation such as image forming, the developer, which is flowed into the developing chamber 215 from the developer 215 via the first opening portion 207*a*, is conveyed in the direction of the arrow B by the conveying blade portion 2061 of the mixing screw 206. However, in a downstream position, the developer is pushed back by the returning blade portion 2062, and is flowed into the developing chamber 215 from the mixing chamber 216 via the second opening portion 207*b*. In this way, the developer is suppressed to flow into the discharging passage 213 and discharged from the discharging port 208. Thus, it is not enough to discharge the sufficient developer from the discharging port 208 by simply rotationally driving the mixing screw 206. Therefore, constitutions as will be described below is adopted in the embodiment.

[Shielding Member]

The developer 200*a* in the embodiment is constituted to be capable of switching by a shielding member 211, between an opening state that the developer is able to pass through the second opening portion 207*b* which is an opening portion in a side near the discharging port 208 and a shielded state that the developer is shielded to pass through the second opening portion 207*b*. This point will be described by using FIG. 7 through FIG. 9.

Figure 7:
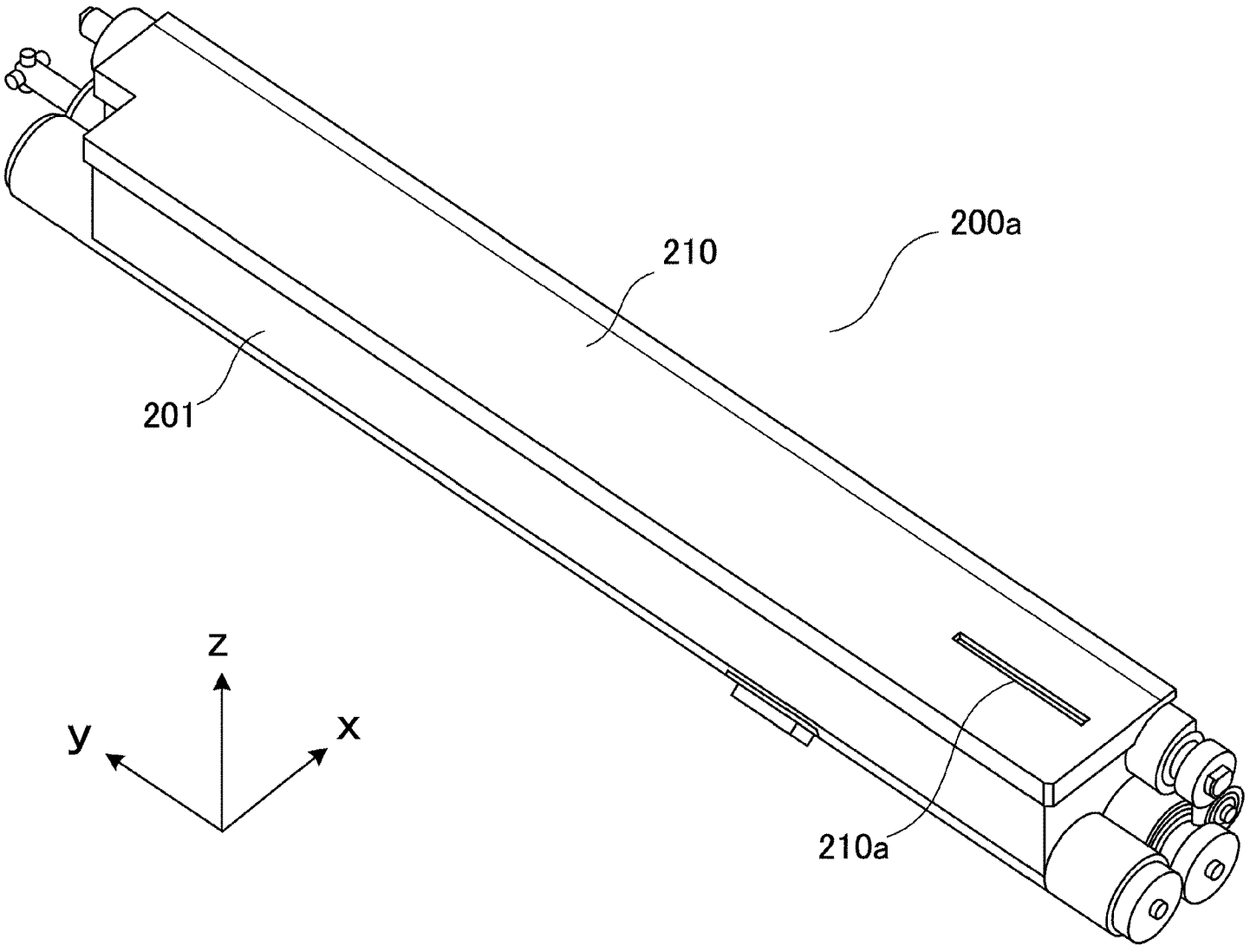
FIG. 7 is a perspective view showing the developing device while the top cover is mounted according to the first embodiment.
Figure 8:
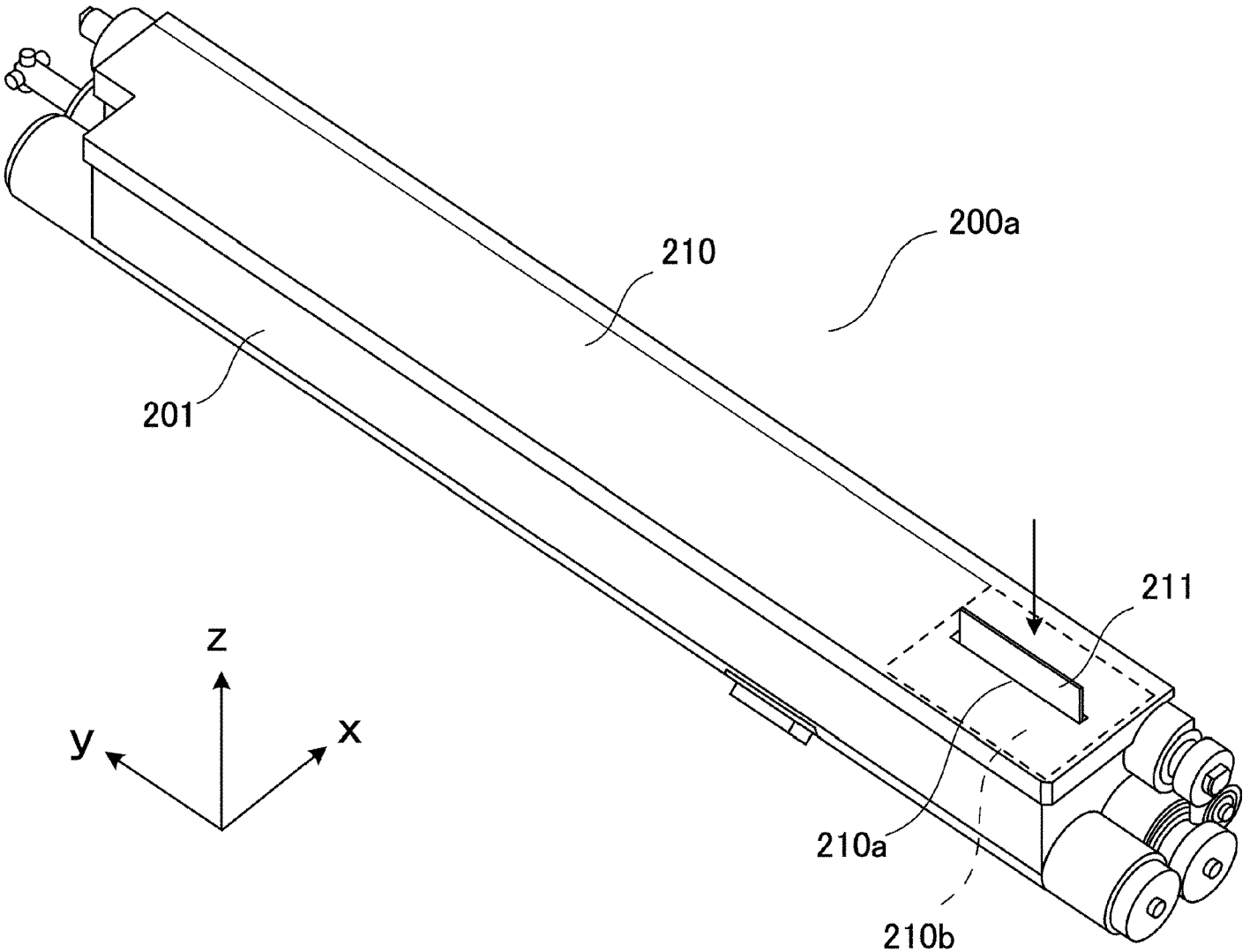
FIG. 8 is a perspective view showing the developing device while a shielding member is inserted according to the first embodiment.

FIG. 7 and FIG. 8 are perspective views of the developing device 200*a*. As shown in FIG. 7, the developing top cover 210 is provided with an insertion opening 210*a* for inserting the shielding member 211 which is capable of shielding the second opening portion 207*b*, in a substantially upper position of the second opening portion 207*b* which is closer to the discharging port 208 among the first opening portion 207*a* and the second opening portion 207*b*. As described above, the developing top cover 210 is a cover to cover above the developer container 201, that is, the developing chamber 215 and the mixing chamber 216. And in the developing top cover 210, the insertion opening 210*a*, which is possible to insert the shielding member 211, is formed.

The shielding member 211 is a sheet shaped member, such as a plastic sheet. When the developing device 200*a* is in use, such the shielding member 211 is not inserted into the insertion opening 210*a*, and in a case of replacing the developing device 200*a* due to a reason such as deterioration of the developer, as shown in FIG. 8, an operator such as a service person inserts the shielding member 211 into the insertion opening 210*a*. Incidentally, when the developing device 200*a* is in use, it is desirable that the insertion opening 210*a* is sealed with an unshown sheet or a sponge etc., for example.

Figure 9:
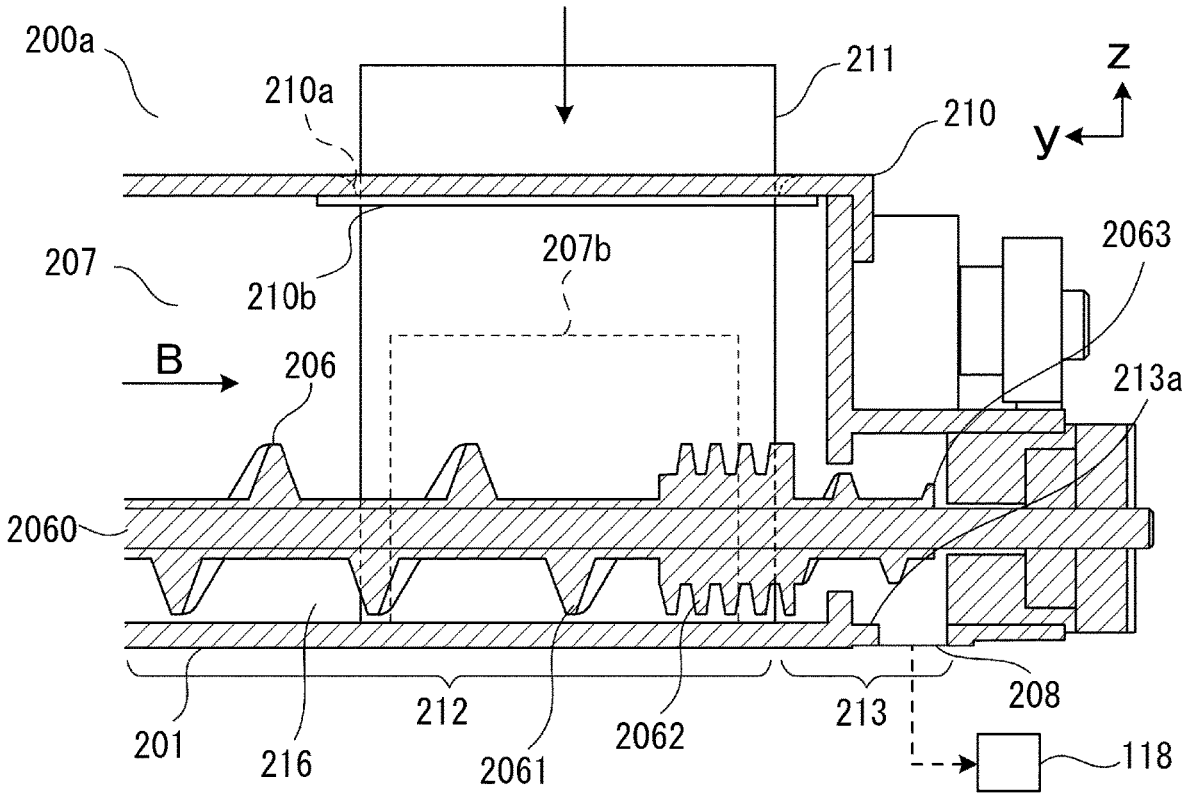
FIG. 9 is a sectional view of an area around a second opening portion while the shielding member is inserted into the developing device according to the first embodiment.

FIG. 9 is an enlarged view of a vicinity of the second opening portion 207*b* in a section which is cut perpendicular to the x-axis along a rotational axis of the mixing screw 206, while the shielding member 211 is inserted into the insertion opening 210*a*. As shown in FIG. 9, the shielding member 211 is larger than a width of the second opening portion 207*b* and is guided by the insertion opening 210*a*, and an entire area of the second opening portion 207*b* is shielded. Further, it is desirable that the shielding member 211 inserts along a surface of the partition wall 207 in a side of the mixing screw 206. As will be described below, in a case of discharging the developer in the developer container 201, the conveying screw 205 and the mixing screw 206 are driven, and in this time, a flow of the developer passing through the second opening portion 207*b* is in a direction from the mixing chamber 216 to the developing chamber 215. Thus, by arranging the shielding member 211 in a side of the mixing chamber 216 of the partition wall 207, the shielding member 211 is pushed toward the partition wall 207 by a pressure of the developer in a side of the mixing chamber 216. As a result, it is possible to seal a gap between the shielding member 211 and a surface of the partition wall 207 more firmly.

In the embodiment, the insertion opening 210*a* is formed so that the shielding member 211 is positioned in an upstream side of the flow direction of the developer which is passing through the second opening portion 207*b* with respect to the partition wall 207. Then, in a case that the shielding member 211 is inserted into the insertion opening 210*a*, the shielding member 211 is arranged along the surface of the side of the mixing chamber 216 of the partition wall 207. With this constitution, it is possible to block the flow of the developer which is passing through the second opening portion 207*b* by the shielding member 211 without a need for a complicated constitution.

Incidentally, inside the developing top cover 210, a sealing member 210*b* is constituted with a flexible form such as a rubber so as to cover the insertion opening 210*a*. The sealing member 210*b* is provided with a cutout along the insertion opening 210*a* and a gap between the shielding member 211 and the insertion opening 210*a* is sealed while the shielding member 211 is inserted. In this way, it is possible to suppress a leakage of the residual developer from the gap between the shielding member 211 and the insertion opening 210*a* during a transportation of the used developing device 200*a*.

[Developer Discharging Mode]

Next a developer discharging mode, in which the developer is discharged from the used developing device by using the constitution described above, will be described. First, the control portion 240 of the image forming apparatus 100 is capable of executing an image forming mode which conducts a normal developing operation as a first mode and a developer discharging mode as a second mode. In the image forming mode, the conveying screw 205 and the mixing screw 206 are driven in a forward direction in an open state in which the second opening portion 207*b* is not shielded by the shielding member 211. In the developer discharging mode, the conveying screw 205 and the mixing screw 206 are driven in a forward direction in a shielded state in which the second opening portion 207*b* is shielded by the shielding member 211. Incidentally, as described above, the motor 230, which drives the conveying screw 205 and the mixing screw 206, also drives the developing sleeve 203, so the motor 230 drives the developing sleeve 203 in the image forming mode and the developer discharging mode.

That is, in the developer discharging mode, after the second opening portion 207*b* is shielded by the shielding member 211, the motor 230 drives the developing sleeve 203, the conveying screw 205, and the mixing screw 206 in a same direction as a direction during circulating and conveying of the developer (during image forming). In this case, driving speeds of the developing sleeve 203, the conveying screw 205, and the mixing screw 206 in the developer discharging mode are the same as those of the developing sleeve 203, the conveying screw 205, and the mixing screw 206 in the image forming mode. A time for executing the developer discharging mode is set as a predetermined time (for example 180 seconds). That is, when a predetermined time is passed after the developer discharge mode is started, the driving of the developer sleeve 203, the conveying screw 205 and the mixing screw 206 are stopped.

In this way, the developer in the developing chamber 215 is conveyed in the direction of the arrow Ain FIG. 4 by the conveying screw 205, and is flowed into the mixing chamber 216 via the first opening portion 207*a*. On the other hand, the developer in the mixing chamber 216 is blocked from passing into the developing chamber 215, since the second opening portion 207*b* is shielded by the shielding member 211. Thus, the developer in the mixing chamber 216 is retained in a downstream portion with respect to the developer conveying direction (direction of arrow B in FIG. 4) of the mixing screw 206. As a result, when a surface height of the developer in the downstream portion with respect to the developer conveying direction of the mixing screw 206 rises, and the developer climbs over the returning blade portion 2062 and flows into the discharging passage 213.

The developer, which is flowed into the discharging passage 213, is discharged from the discharging port 208 by the discharging blade portion 2063, and as shown in FIG. 5 and FIG. 9, the developer is collected and stored in the collecting container 118 which is connected to the discharging port 208. Further, the developer, which is retained on the surface of the developing sleeve 203, is separated as the developing sleeve 203 rotates, and is collected in the developing chamber 215. And as an amount of the developer in the developing chamber 215 decreases, a new developer is not lifted up to the surface of the developing sleeve 203 and its surface becomes a state that the developer is separated.

Incidentally, in the embodiment, as shown in FIG. 6, a constitution, in which the discharging blade portion 2063 which conveys the developer in the discharging passage 213 is provided in the downstream side of the mixing screw 206 with respect to the developer conveying direction, is shown. However, it is not necessarily limited to this, and the discharging blade portion 2063 may be omitted in a case that the developer is properly discharged from the discharging port 208 without the discharging blade portion 2063 by, for example, a shape of the discharging passage 213, an arrangement of the discharging port 208, etc.

Figure 10:
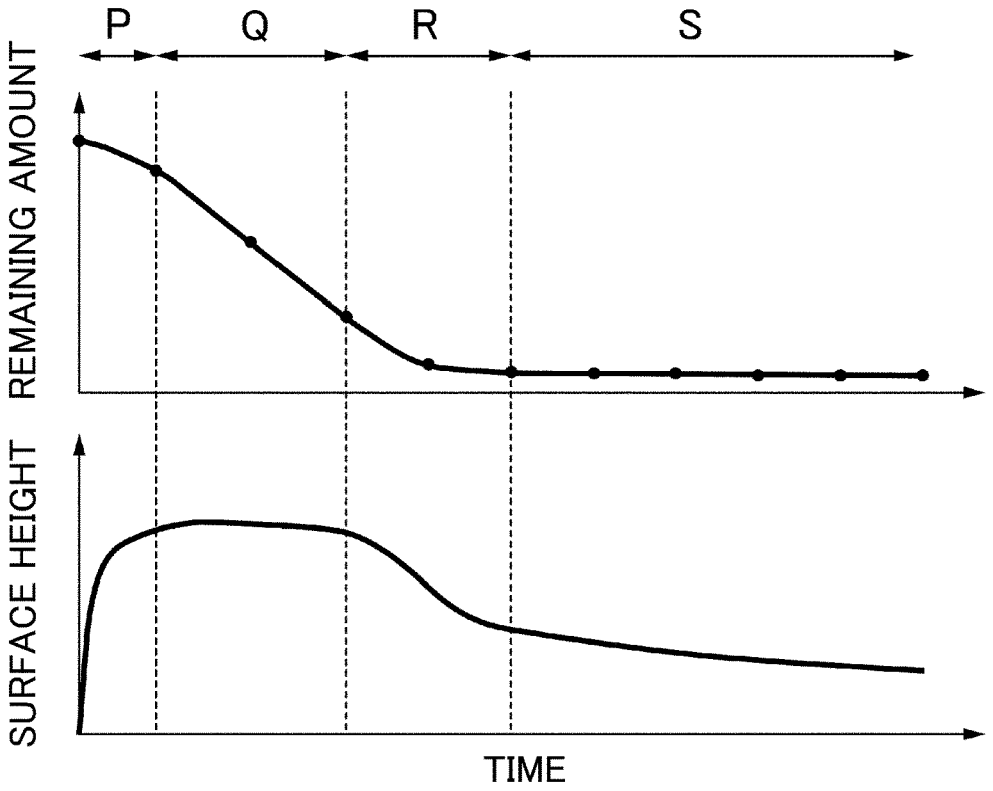
FIG. 10 is a graph showing a transition of a remaining amount of developer and a height of a developer surface at a time of discharging developer in the developing device according to the first embodiment.

FIG. 10 shows a transition of an amount of the developer remaining in the developer container 201 when the motor 230 is driven while the shielding member 211 shields the second opening portion 207*b*, and a transition of a developer surface height in a vicinity of the returning blade portion 2062. When the motor 230 is driven, as the developer surface height gradually increases, the amount of the remaining developer starts to decrease by discharging the developer. After a while, the developer surface height stabilizes and the developer decreases at a substantially constant rate (section Q). After that, as the developer surface height gradually begins to descend, a decreasing rate of the amount of the remaining developer also becomes slower (section R), and after a certain amount of time is passed, the decrease of the amount of the remaining developer almost stops (section S), and the discharging is completed.

Incidentally, in the description above, the driving speeds of the developing sleeve 203, the conveying screw 205, and the mixing screw 206 are set to be the same in the developer discharging mode and the image forming mode. However, the control portion 240 may control the driving speeds of the developing sleeve 203, the conveying screw 205, and the mixing screw 206 in the developer discharging mode as will be described below. That is, during a first period from a start of the developer discharging mode (start of driving of motor 230), the driving speeds of the developing sleeve 203, the conveying screw 205, and the mixing screw 206 are set to be slower than those in the image forming mode. And during a second period following the first period, the driving speed are set to be the same as in the image forming mode.

First, during an execution of the developer discharging mode, the mixing screw 206 may lock due to a heavy load when trying to rotate the mixing screw 206 in such a state, since an amount of the developer in the mixing chamber 216 is large. Therefore, in the developer discharging mode, during the first period, by driving the conveying screw 205 and the mixing screw 206 slowly, the developer is discharged from the discharging port 208. And, at a time when the amount of the developer in the mixing chamber 216 is decreased to some extent, that is, at a time when a risk of screw lock is eliminated, the second period is started and the screw speed is set to be the same as at a time of image forming. In this way, it is possible to discharge the developer from the discharging port 208 promptly.

[First Example of Developer Discharging Mode Flow]

Here, a first example of a developer discharging mode flow described above will be described by using FIG. 11 and FIG. 12. The image forming apparatus 100 in the embodiment includes the plurality of developing device as described above. That is, the image forming apparatus 100 includes the plurality of developing devices from 200*a* through 200*d*. In the example, the control portion 240 is designed to execute the developer discharging mode for a selected developing device from the plurality of the developing devices from 200*a* through 200*d*.

Figure 11:
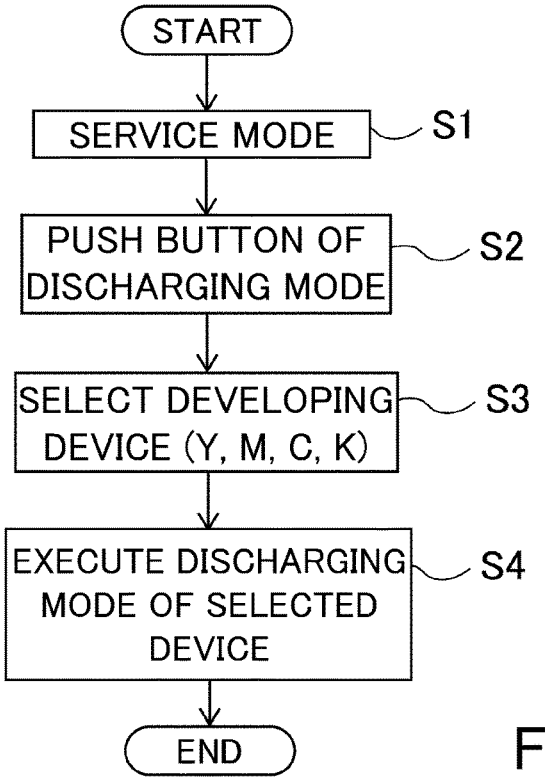
FIG. 11 is a flow chart showing a first example of a flow of a developer discharge mode according to the first embodiment.

Specifically, as shown in FIG. 11, for example, an operator such as a service person operates the operation portion 120 (FIG. 1), and the image forming apparatus 100 is changed to a service mode (S1). Incidentally, the service mode is a special mode for maintaining the image forming apparatus 100. Then, on a screen in the service mode which is displayed on the touch panel 121 of the operation portion 120, a button for executing the developer discharging mode is pushed down (S2).

Figure 12:
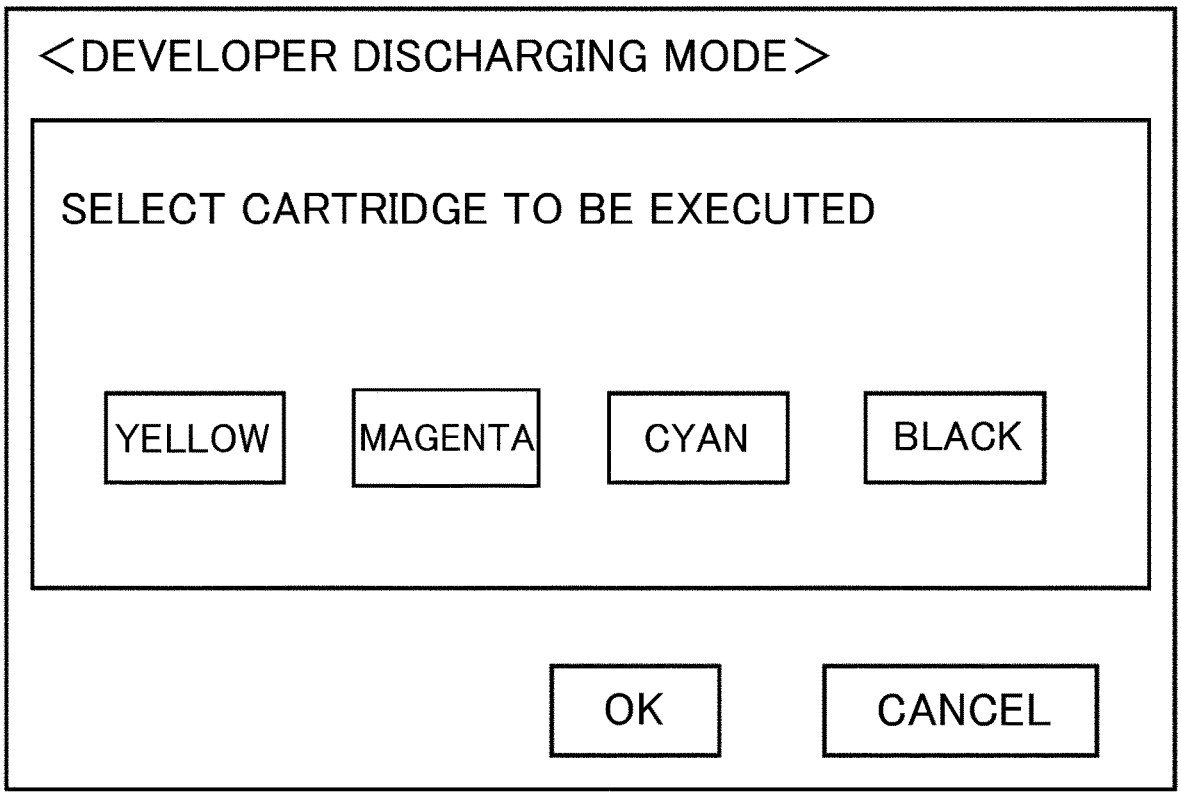
FIG. 12 is an illustration showing the first example of a display screen in a case of executing the developer discharge mode according to the first embodiment.

Then, for example, a screen, which is shown in FIG. 12, is displayed on the touch panel 121 of the operation panel 120 which is also a selection portion. An operator selects the developing device to execute the developer discharging mode by touching a color of the developing device (cartridge) which the operator would like to execute the developer discharging mode (S3). The control portion 240 executes the developer discharging mode described above for the developing device which is touched by the operator (S4).

Incidentally, before executing the developer discharging mode described above, the shielding member 211 is inserted into the developing device in which the operator would like to execute the developer discharging mode. A timing for inserting the shielding member 211 may be any time before executing the developer discharging mode. For example, the timing of inserting the shielding member 211 is before or after shifting to the service mode, when the button for executing the developer discharging mode is pushed down, when the developing device which the operator would like to execute the developer discharging mode is selected, etc. Further, for example, when the operator selects the developing device in which the operator would like to execute the developer discharging mode, the touch panel 121 displays that the shielding member 211 is to be inserted into the selected developing device. And after inserting the shielding member 211, the developer discharging mode may be executed by mounting the developing device on the main assembly 100A. Further, in this case, the developer discharging mode may be executed by displaying a confirmation button and pushing down the confirmation button.

[Second Example of the Developer Discharging Mode Flow]

Next, a second example of a developer discharging mode flow described above will be described by using FIG. 13 and FIG. 14. In the example, in a case that a value related to a lifetime reaches a predetermined threshold value, the fact and whether or not to execute the developer discharging mode are displayed on the operation panel 120, and in a case that an execution of the developer discharging mode is selected, the developer discharging mode is executed. Regarding whether the developing device reaches an end of a lifetime, for example, in a case that each number of sheets of recording materials used by each of the developing devices is counted and each number of sheets counted reaches a predetermined value, the control portion 240 may determine that the developing device reaches the end of the lifetime. Further, regarding whether the developing device reaches the end of the lifetime, for example, in a case that each number of rotations of the developing sleeve 203 of each of the developing devices is counted and each number of rotations reaches a predetermined value, the control portion 240 may determine that the developing device reaches the end of the lifetime as a variation.

Figure 13:
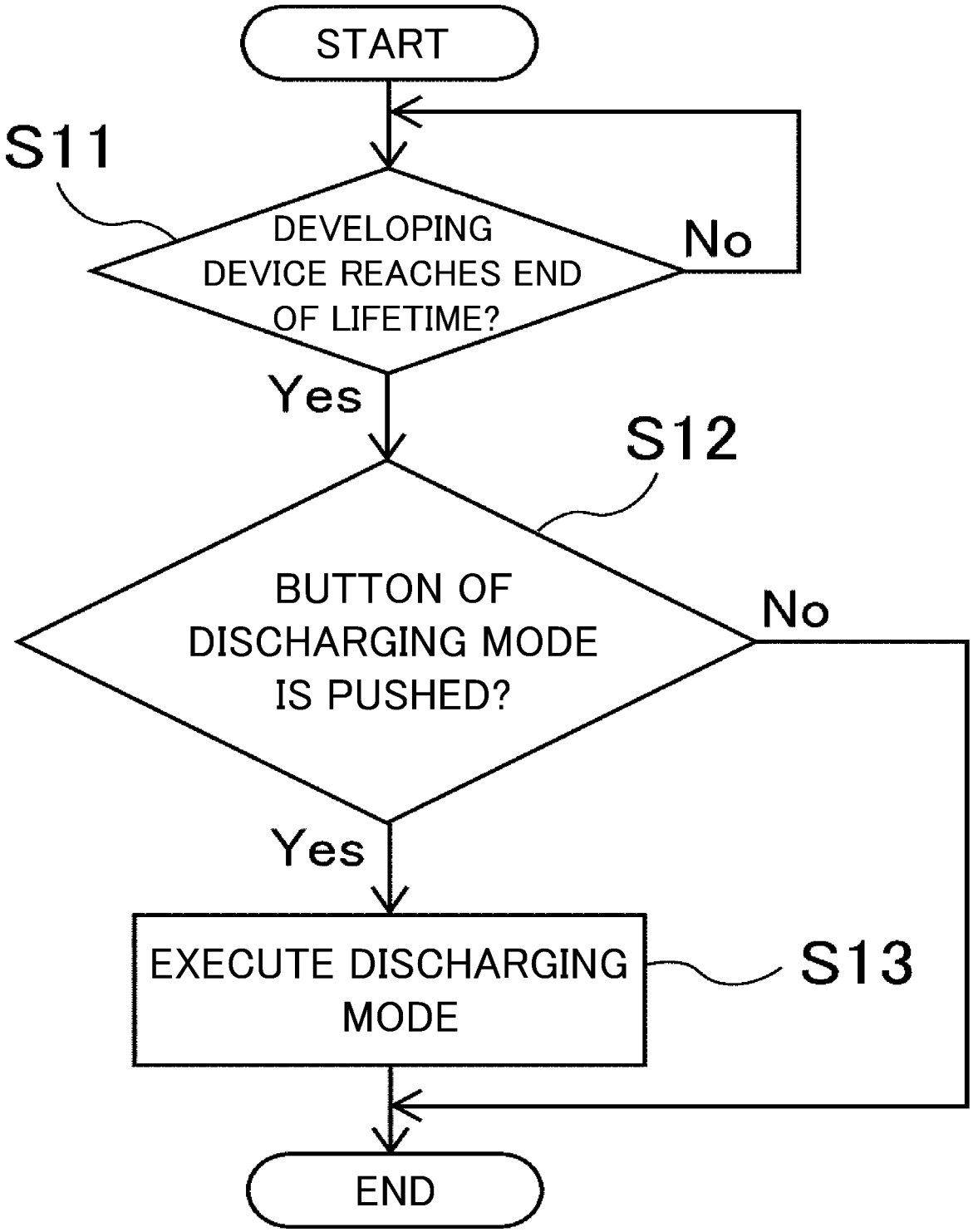
FIG. 13 is a flow chart showing a second example of a flow of a developer discharge mode according to the first embodiment.
Figure 14:
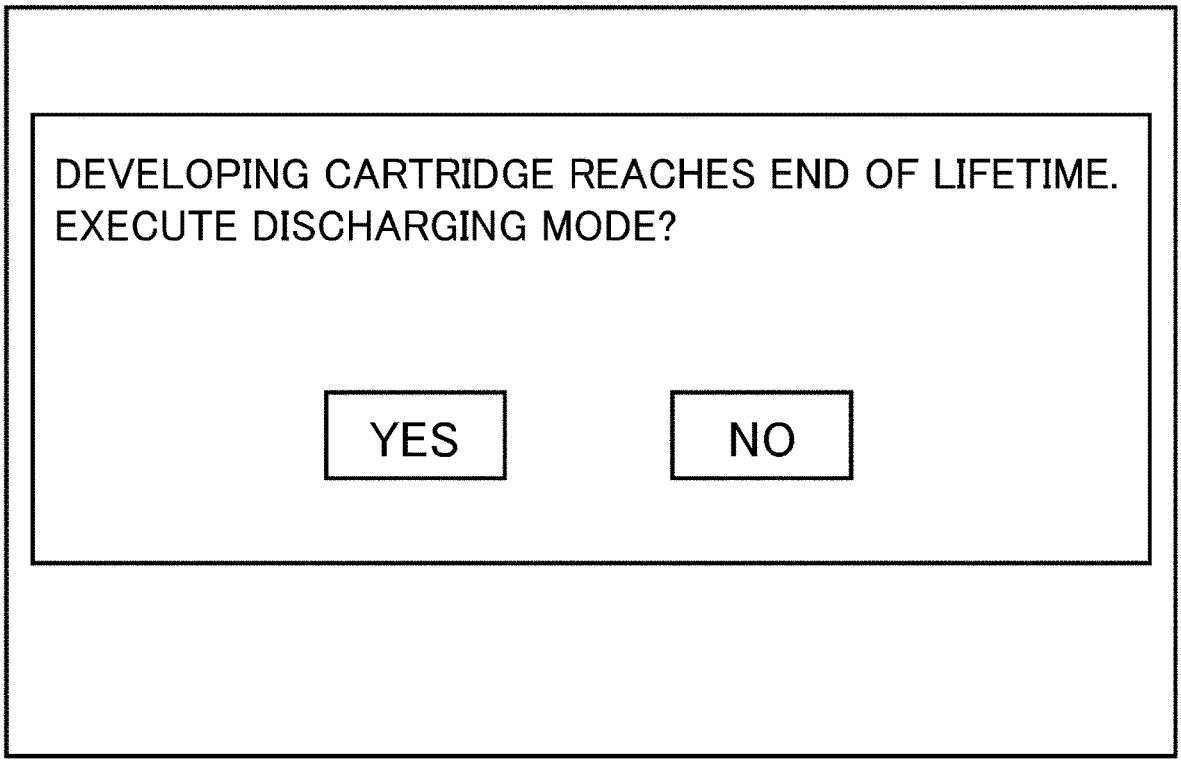
FIG. 14 is an illustration showing the second example of a display screen in a case of executing the developer discharge mode according to the first embodiment.

Specifically, as shown in FIG. 13, the control portion 240 determines whether the developing device reaches the end of the lifetime (S11). In a case that the developing device (developing cartridge) reaches the end of the lifetime (YES in S11), a screen shown in FIG. 14 is displayed on the touch panel 121 of the operation portion 120. Then, when the operator pushes a button ("YES" in FIG. 14) of a developer discharging mode execution (YES in S12), the control portion 240 executes the developer discharging mode (S13).

Incidentally, in the example as well, in a case that it is determined that the developing device reaches the end of the lifetime (YES in S11), a screen as shown in FIG. 12 may be displayed on the touch panel 121. In this case, a color of the developing device which is displayed on the touch panel 121 is displayed so as to indicate that the control portion 240 determines that the developing device reaches the end of the lifetime. For example, only the developing device which reaches the end of the lifetime may be selectable in such a way of displaying only the developing device which reaches the end of the lifetime, displaying the developing device which reaches the end of the lifetime and the developing device which does not reach the end of the lifetime separately, etc. And in a way that the developing device is selected on the touch panel 121, it may be determined that "the button of the developer discharging mode execution is pushed".

In this way, in the embodiment, by driving the conveying screw 205 and the mixing screw 206 while the second opening portion 207*b* near the discharging port 208 is shielded by the shielding member 211, the developer in the developer container 201 is discharged from the discharging port 208. Thus, even in a constitution that the conveying screw 205 and the mixing screw 206 are arranged so that they overlap at least partially when viewed horizontally, it is possible to discharge the developer properly.

That is, even in the developing device 200*a* in which the developing chamber 215 and the mixing chamber 216, where the developer is circulated, are arranged in a substantially horizontal direction, it is possible to discharge the developer by shielding the second opening portion 207*b* which is the one closer to the discharging port 208 of two opening portions which are provided in both ends of the partition wall 207. In this way, it is possible to suppress a scattering of the developer due to transportation for collecting the developing device and reduce a cleaning cost for recycling.

Second Embodiment

A second embodiment will be described by using FIG. 15. In the embodiment, the shielding member 211*a* is designed to be less likely to pull out, while the shielding member 211*a* is inserted into the insertion opening 210*a*. Since other constitutions and actions are same as those of the first embodiment described above, same reference numerals are attached to same constitutions, and descriptions and illustrations for the same constitutions are omitted or simplified, and points which differ from the first embodiment will be mainly described below.

Even when the developer discharging mode is executed and the developer discharging is completed, a small amount of the developer may remain in a vicinity of the returning blade portion 2062 of the mixing screw 206. Thus, it is desirable that the shielding member 211*a* remains inserted into the insertion opening 210*a*, in order to prevent from dispersing the residual developer to an outside of the developing device 200*a* passing through the second opening portion 207*b*, when the developing device 200*a* is collected. Further, by a vibration of the collected developing device 200*a* during a transportation, etc., the shielding member 211*a* may fall off unintentionally.

Figure 15:
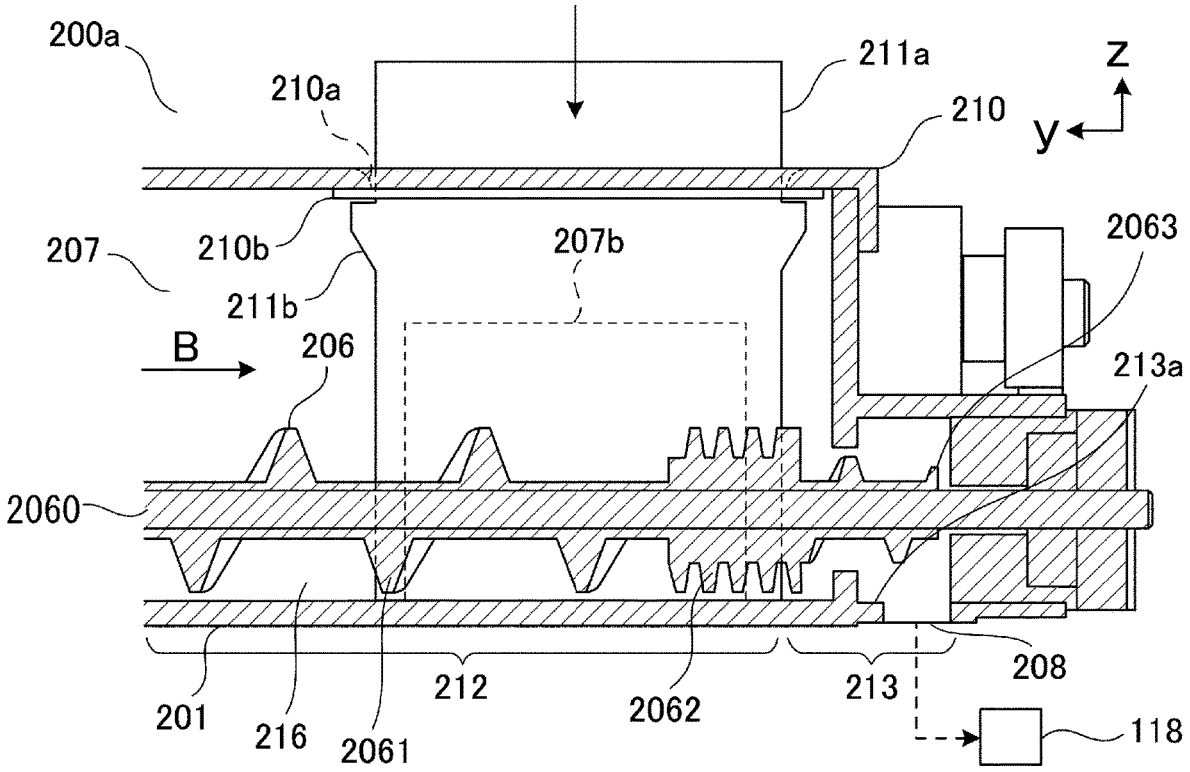
FIG. 15 is a sectional view of an area around a second opening portion while the shielding member is inserted into the developing device according to a second embodiment.

Therefore, in the embodiment, as shown in FIG. 15, a returning shape 211*b* as a locking portion is provided with an end portion of the shielding member 211*a*. And, after inserting the shielding member 211*a* into the insertion opening 210*a*, the returning shape 211*b* prevents from pulling off of the shielding member 211*a* by hooking onto an inside edge of the insertion opening 210*a*. That is, the shielding member 211*a* in the embodiment includes the returning shape 211*b* as the locking portion which locks in an inside surface of the developing top cover 210 (in the embodiment, the sealing member 210*b* which is arranged on the inside surface), while the shielding member 211*a* is inserted into the insertion opening 210*a*.

The returning shapes 211*b* are formed so as to protrude toward each outside with respect to a width direction at both ends of the shielding member 211*a* with respect to the width direction, and further, each end portion of a downstream side with respect to an insertion direction is formed to be an inclined surface which is inclined to an inside with respect to the width direction as it comes to a downstream side. Further, an upstream end of the returning shape 211*b* with respect to the insertion direction is designed to be a straight line shape which is substantially parallel to the inside surface of the developing top cover 210. In this way, when the shielding member 211*a* is inserted into the insertion opening 210*a*, the inclined surface of the returning shape 211*b* serves as a guide, the returning shape 211*b* is elastically deformed, and the shielding member 211*a* is inserted into the insertion opening 210*a*. And, after insertion, the returning shape 211*b* is elastically restored, the straight line shape portion is locked in the inside surface of the developing top cover 210, and then, the shielding member 211*a* is prevented from pulling off from the insertion opening 210*a*.

In a case of such the embodiment, since the shielding member 211*a* is prevented from pulling off after inserting into the insertion opening 210*a*, it is possible to further suppress a leakage of the developer during a transportation of the used developing device, etc.

Third Embodiment

A third embodiment will be described by using FIG. 16 and FIG. 17. In the embodiment, it is constituted so as to be arranged to seal the insertion opening 210*a* while the shielding member 211*c* is not inserted into the insertion opening 210*a*. Since other constitutions and actions are the same as those of the first embodiment described above, same reference numerals are attached to same constitutions, and descriptions and illustrations for the same constitutions are omitted or simplified, and points which differ from the first embodiment will be mainly described below.

At a time of an initial shipment of the developing device 200*a*, there is a constitution in which a part of a space in the developer container 201 is sealed with sheet material, etc. and an initial developer is enclosed at a high filling rate. In such the constitution, in a case that the insertion opening 210*a* is constituted of a part of a sealed space, the sealing member 210b with the cutout described above may not be enough to seal. In such cases, an insertion opening cover member may be provided separately to cover the insertion opening 210*a*. However, in the case that the insertion opening cover is provided separately, a number of parts may increase.

Figure 16:
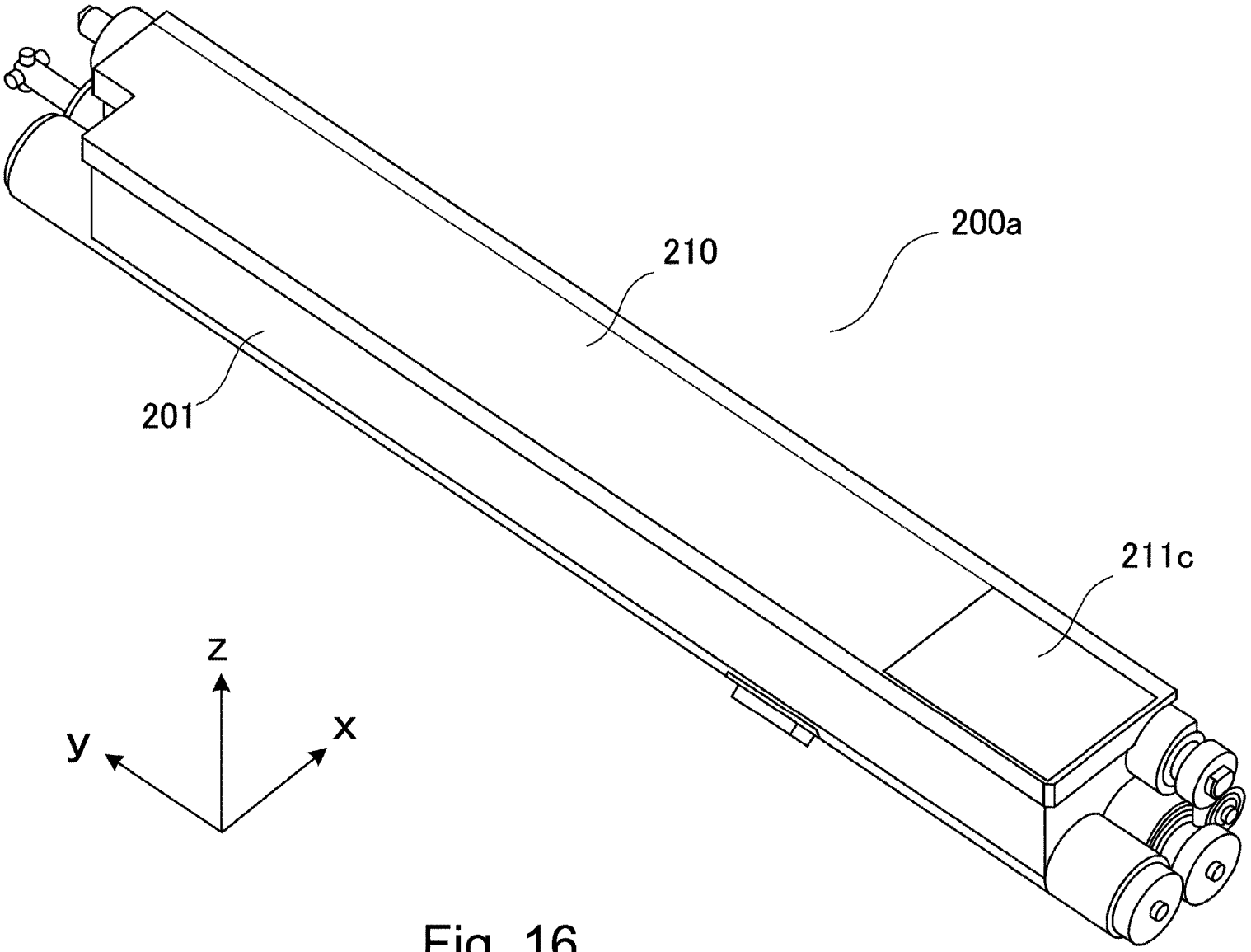
FIG. 16 is a perspective view showing a state in which a shielding member is adhered to an insertion opening of the developing device according to a third embodiment.
Figure 17:
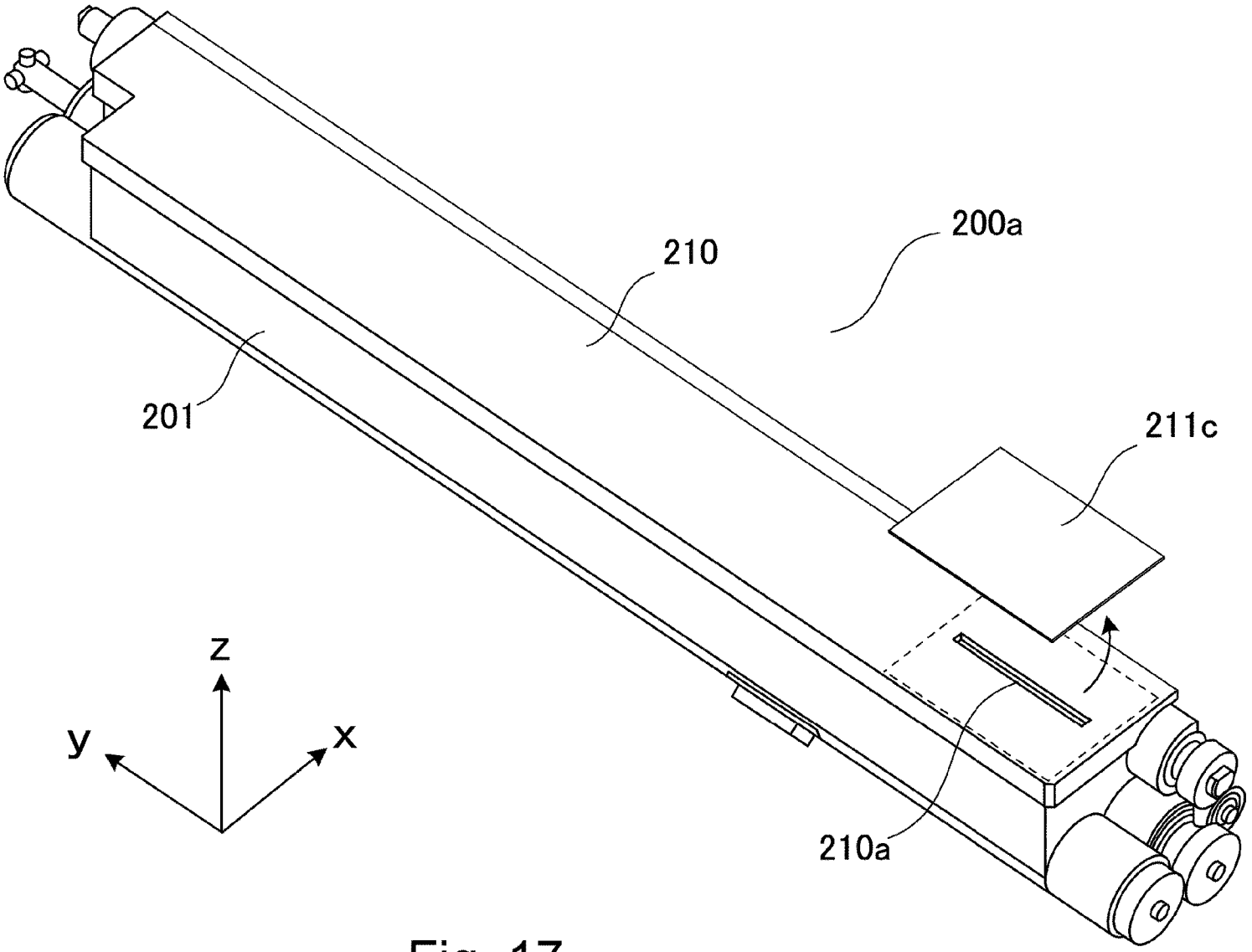
FIG. 17 is a perspective view showing a state in which the shielding member is removed from the insertion opening of the developing device according to the third embodiment.

Therefore, in the embodiment, as shown in FIG. 16, the shielding member 211*c* is pasted on the developing top cover 210 removably, so as to cover the insertion opening 210*a*. And in a case of replacing the used developing device 200*a*, as shown in FIG. 17, the shielding member 211*c* is removed from the developing top cover 210 and the insertion opening 210*a* is exposed, and as shown in FIG. 10, the shielding member 211*c*, which is removed, is inserted into the insertion opening 210*a*. That is, the shielding member 211*c* in the embodiment is constituted to be pasted on an outer surface of the developing top cover 210 so as to seal the insertion opening 210*a* in a state that the shielding member 211*c* is not inserted into the insertion opening 210*a*, while the shielding member 211*c* is constituted to be removed from the outer surface of the developing top cover 210 in a case of inserting into the insertion opening 210*a*.

With such the constitution, at the time of the initial shipment of the developing device 200*a*, the shielding member 211*c* covers the insertion opening 210*a*, so it is possible to suppress an initial leakage of the developer from the insertion opening 210*a*. On the other hand, at the time of replacing the used developing device 200*a*, by removing the shielding member 211*c* and inserting it into the insertion opening 210*a*, it is possible to shield the second opening portion 207*b* and execute the developer discharging mode as described above.

Incidentally, the insertion opening 210*a* may be exposed by providing a perforation and cutting it out, and the shielding member 211*c*, which is cut out, may be inserted into the insertion opening 210*a*. Further, the shielding member may also be a shielding member whose shape is like the second embodiment.

Fourth Embodiment

The fourth embodiment will be described by using parts (a) and (b) of FIG. 18. In each of the embodiments described above, the conveying screw 205 is arranged below the developing sleeve 203, and the developing chamber 215 and the mixing chamber 216 are arranged in a substantially horizontal direction, however, in the present invention, it is possible to apply for an arrangement in which heights of the developing chamber 215 and the mixing chamber 216 are different. In the embodiment, two examples of constitutions in which the heights of the developing chamber 215 and the mixing chamber 216 are different. Since other constitutions and actions are same as at least one of the first embodiment, the second embodiment, and the third embodiment described above, the same reference numerals are attached to the same constitutions, and descriptions and illustrations for the same constitutions are omitted or simplified, and points which differ from the first embodiment will be mainly described below.

First, in a case of a constitution of the first example in the embodiment shown in part (a) of FIG. 18, in a downstream side of the mixing screw 206 of the mixing chamber 216 which is provided with the discharging port 208 with respect to a developer conveying direction, a position of a bottom of the mixing chamber 216 is constituted to be higher than a position of a bottom of the developing chamber 215. That is, the mixing screw 206 and the mixing chamber 216 are constituted so that they become higher as it comes toward the downstream side with respect to the developer conveying direction of the mixing screw 206. In this constitution, the conveying screw 205 is also arranged below the developing sleeve 203. Furthermore, in the constitution, the developing chamber 215 and the mixing chamber 216 are arranged horizontally adjacent to each other, and the conveying screw 205 and mixing screw 206 are arranged so that they overlap at least partially when viewed from a horizontal direction.

In the example, in the second opening portion 207*b*, which is closer to the discharging port 208, the developer flows into the developing chamber 215 from the mixing chamber 216 by receiving an effect of gravity as well. However, by shielding the second opening portion 207*b* during the developer discharging mode, it is possible to block an inflow of the developer from the mixing chamber 216 to the developing chamber 215 and to discharge the developer. Incidentally, the same applies to a constitution in which the conveying screw 205 and the mixing screw 206 are arranged in parallel, a top of an outer diameter of the mixing screw 206 is higher than a top of an outer diameter of the conveying screw 205, and, furthermore, a position of a bottom of the mixing chamber 216 is higher than a position of a bottom of the developing chamber 215.

Next, in a case of a constitution of the second example in the embodiment as shown in part (b) of FIG. 18, in the downstream side of the mixing screw 206 of the mixing chamber 216 which is provided with the discharging port 208 with respect to the developer conveying direction, the position of the bottom of the mixing chamber 216 is constituted to be lower than the position of the bottom of the developing chamber 215. That is, the mixing screw 206 and the mixing chamber 216 are constituted so that they become lower as it comes toward the upstream side with respect to the developer conveying direction of the conveying screw 205. In this constitution, the conveying screw 205 is also arranged below the developing sleeve 203. Furthermore, in the constitution, the developing chamber 215 and the mixing chamber 216 are also arranged horizontally adjacent to each other, and the conveying screw 205 and mixing screw 206 are arranged so that they overlap at least partially when viewed from the horizontal direction.

In this example, even though the mixing chamber 216 is lower than the developing chamber 215 as described above, when a lower end 2071*b* of the second opening portion 207*b* which is closer to the discharging port 208 is positioned below an upper end of the outer diameter of the mixing screw 206, the developer flows into the developing chamber 215 from the mixing chamber 216 in the second opening portion 207*b*. However, in a case of such the example, by shielding the second opening portion 207*b* during the developer discharging mode, it is also possible to block the inflow of the developer from the mixing chamber 216 to the developing chamber 215 and to discharge the developer. Incidentally, the same applies to the constitution in which the conveying screw 205 and the mixing screw 206 are arranged in parallel, the top of the outer diameter of the mixing screw 206 is lower than the top of the outer diameter of the conveying screw 205, and, furthermore, the position of the bottom of the mixing chamber 216 is lower than a position of a bottom of the developing chamber 215.

Fifth Embodiment

A fifth embodiment will be described by using FIG. 19 with reference to each of figures described above. In the embodiment, the discharging port 208 is arranged in a downstream side (downstream side with respect to first direction) with respect to the developer conveying direction of the conveying screw 205 in the developing chamber 215. Since other constitutions and actions are the same as those of the first embodiment described above, the same reference numerals are attached to same constitutions, and descriptions and illustrations for the same constitutions are omitted or simplified, and points which differ from the first embodiment will be mainly described below.

In the embodiment, as described above, the discharging port 208 is arranged in the downstream side of the first opening portion 207*a* of the developing chamber 215. Thus, as described in FIG. 19, a returning blade portion 2052 as a reverse conveying portion, possesses a conveying force in an opposite direction (direction of arrow Kb) to the developer conveying direction (direction of arrow Ka) in the downstream side of the conveying screw 205 with respect to the developer conveying direction. The conveying screw 205 is provided with a conveying blade portion 2051 which possess a conveying force in the developer conveying direction (direction of arrow Ka). In a downstream side of the conveying blade portion 2051 with respect to the developer conveying direction, the returning blade portion 2052, which possess a conveying force which is an opposite direction (direction of arrow Kb) to the direction of the arrow Ka and whose pitch is smaller than the conveying blade portion 2051, is provided. The returning blade portion 2052 is arranged in a downstream side than an upstream end of the first opening portion 207*a* and in an upstream side than the discharging port 208 with respect to the developer conveying direction of the conveying screw 205 (direction of arrow Ka). And the developer, which is conveyed by the conveying blade portion 2051 of the conveying screw 205, is conveyed in the opposite direction (direction of arrow Kb) to the developer conveying direction (direction of arrow Ka) of the conveying screw 205.

Further, in the downstream side of the conveying screw 205 than the returning blade portion 2052 with respect to the developer conveying direction (direction of arrow Ka), the discharging blade portion 2053, which possesses a conveying force in a same direction as the direction of the arrow Ka, is provided. And a rotational axis 2050 of the conveying screw 205 is rotatably provided over a conveying passage and a discharging passage of the developer, and integrally rotates the returning blade portion 2052 and the discharging blade portion 2053.

When executing the developer discharging mode, the first opening portion 207*a*, which is closer to the discharging port 208, is shielded by the shielding member 211. That is, in a case of the embodiment, an opening portion, which is able to switch between an opened state and a shielded state by the shielding member 211, is the first opening portion 207*a*. Thus, the insertion opening 210*a* of the shielding member 211 is arranged in a substantially upper position of the first opening portion 207*a*.

Further, the insertion port 210*a* is formed so that the shielding member 211 is positioned in an upstream side of the partition wall 207 with respect to a direction of a flow of the developer passing through the first opening portion 207*a*. And, when the shielding member 211 is inserted into the insertion opening 210*a*, it is arranged so that the shielding member 211 is aligned along a surface of the developing chamber 215 side of the partition wall 207. In this way, without any needs of complex constitutions, it is possible to shield the flow of the developer, which is passing through the first opening portion 207*a*, by the shielding member 211.

Incidentally, in the embodiment, the discharging blade portion 2053 may be omitted in a case that the developer is properly discharged from the discharging port 208 by a shape of a discharging passage and an arrangement of the discharging port 208. Further, in the embodiment, it is possible to apply to the constitution of each of the embodiments described above.

Sixth Embodiment

A sixth embodiment will be described by using FIGS. 20 through FIG. 22 with reference to the figures described above. In the embodiment, the present invention is applied to a developing device which adopts a developer automatic replacement method as will be described below, and it is possible to discharge the deteriorated developer from the discharging port 208 which is used for the developer automatic replacement. Since other constitutions and actions are the same as those of the first embodiment described above, the same reference numerals are attached to the same constitutions, and descriptions and illustrations for the same constitutions are omitted or simplified, and points which differ from the first embodiment will be mainly described below.

[Developer Automatic Replacement Method]

In the developing device of the two-component developing method, deterioration of the developer, especially deterioration of the carrier, due to a long term continuous use is inevitable, so some constitutions apply the developer automatic replacement method which aims to extend a lifetime of the developing device. The constitution will be described by using FIG. 20 and FIG. 21. FIG. 20 is a perspective view showing an interior of the developing device 200A in the embodiment, FIG. 21 is a sectional view of the developing device 200A which is cut perpendicular to x-axis along the rotational axis of the mixing screw 206.

In the developer automatic replacement method, in addition to the toner which is consumed by a developing operation of the developing device 200A, a supply developer which includes a small amount of the carrier is supplied to the developing device 200A from a developer supplying portion 119, as well as an excess developer in the developing device 200A is discharged to an external collecting container 118. In the embodiment, the carrier which is included in the supply developer is approximately 10% by a weight ratio. However, a mixing ratio of the carrier should be appropriately adjusted according to a constitution of the developing device 200A, an ease of a deterioration of the developer, a constitution of the image forming apparatus, etc., and it is not necessarily limited to the value.

Since the excess developer is discharged almost simultaneously with supply of the supply developer by the developer automatic replacement method, it is possible to stabilize overall properties of the developer over a long period of time without increasing a size of the image forming apparatus and driving up a cost. Further, since the developer is automatically replaced as an image is formed, it is possible to decrease a frequency of works such as a replacement of the developer and a replacement of the developing device and it contributes a decrease of an operating cost.

As shown in FIG. 20, in the embodiment, the developer supplying portion 119 supplies the supply developer from a developer supplying port 217 which is arranged in an upstream side with respect to the developer conveying direction of the mixing screw 206 in the mixing chamber 216. The toner, in which the supply developer includes, is consumed by image forming, however, the carrier, which is supplied with the toner, is not consumed and remains in the developer container 201. Thus, in a case that the supply developer is continuously supplied in order to keep a constant toner concentration of the developer in the developer container 201, an amount of the developer in the developer container 201 increases along with image forming.

In the embodiment, as shown in FIG. 21, a discharging passage 213, which discharges the developer, is also provided in continuity with a conveying passage 212 of the developer in which the mixing screw 206 is provided, in a downstream side of the mixing screw 206 with respect to the developer conveying direction. And the discharging port 208 is provided with the discharging passage 213. Further, the returning blade portion 2062 and the discharging blade portion 2063 are provided with the mixing screw 206, and the rotational axis 2060 of the mixing screw 206 rotates integrally the returning blade portion 2062 and the discharging blade portion 2063.

When an amount of the developer in the developer container 201 increases by a repeated supply of the supply developer, the excess developer in the mixing chamber 216 climbs over the returning blade portion 2062 and flows into the discharging passage 213. And the excess developer is conveyed to the discharging port 208 by the discharging blade portion 2063 in the discharging passage 213 and discharged. The developer, which is discharged from the discharging port 208, is collected and stored in the collecting container 118.

As described above, in the developer automatic replacement method, the developer is replaced automatically and gradually, by keeping a constant amount of the developer in the developer container 201, while the carrier is supplied as the supply developer with the toner and the excess developer is discharged.

[Developer Discharging Mode Using Discharging Port for Developer Automatic Replacement]

As described above, even in the developing device 200A which adopts the developer automatic replacement method, the developer may be replaced due to reasons such as deterioration of the developer or durability deterioration of other components. In such a case, a procedure how to discharge the developer by using the discharging port 208 for the developer automatic replacement without providing a new discharging port for discharging the developer and an operation of the developing device 200A will be described below.

Similar to the first embodiment, the insertion opening 210*a* and the sealing member 210*b* are provided with the developing top cover 210, and it is possible to shield the second opening portion 207*b*, which is closer to the discharging port 208, by the shielding member 211. In a case of executing the developer discharging mode, after shielding the second opening portion 207*b* with the shielding member 211, the conveying screw 205 and the mixing screw 206 is driven, while supply of the supply developer from the developer supply portion 119 to the developing device 200A is stopped. For example, while a screw for supplying the developer in which the developer supply portion 119 includes is stopped, the conveying screw 205 and the mixing screw 206 are rotationally driven in a forward direction which is the same direction as the image forming mode.

As described above, during image forming, only the excess developer, out of the increased developer by supply, climbs over the returning blade portion 2062 and is discharged. On the other hand, when the second opening portion 207*b* is shielded by the shielding member 211, the inflow of the developer from the mixing chamber 216 to the developing chamber 215 is blocked and the developer is retained in a downstream portion of the mixing screw 206. As a result, when a surface height of the developer in the downstream portion of the mixing screw 206 rises, the developer climbs over the returning blade portion 2062 and flows into the discharging passage 213. The developer, which is flowed into the discharging passage 213, is discharged from the discharging port 208 by the discharging blade portion 2063, and the developer is collected and stored in the collecting container 118.

Further, similar to the first embodiment, in a case that the developing sleeve 203 is also rotated during the developer discharging mode, while the developer, which is retained on the surface of the developing sleeve 203, is collected in the developing chamber 215, the new developer is not lifted up due to a decrease of the developer in the developing chamber 215. Thus it is possible to separate and discharge the developer which is retained on the surface of the developing sleeve 203.

As described above, even in the developing device 200A which adopts the developer automatic replacement method, it is possible to discharge the developer by using the discharging port 208 for the developer automatic replacement. That is, even in the embodiment, during an execution of the developer discharging mode, it is sufficiently possible to discharge the developer in the developing container 201 by shielding the second opening portion 207*b* which is closer to the discharging port with the shielding member 211.

Incidentally, in the embodiment, the discharging blade portion 2053 may be omitted in a case that the developer is properly discharged from the discharging port 208 by a shape of a discharging passage and an arrangement of the discharging port 208.

Further, in the developing device 200A described above, an example, in which the developer supplying port 217 is arranged in an upstream side of the mixing screw 206 in the mixing chamber 216 with respect to the developer conveying direction, is shown. However, the developer supplying port may be arranged at a position after the developer, which is collected in the developer container 201 from the developer sleeve 203 accompanied with a rotation of the developing sleeve 203 after developing an electrostatic latent image, is merged into the circulating passage, for example, at a position of a downstream side of the developing chamber 215 with respect to the developer conveying direction. In this case, as shown in FIG. 22, the returning blade portion 2052 which possesses the conveying force in the opposite direction (direction of arrow Kb) to the developer conveying direction (direction of arrow Ka) in the downstream side of the conveying screw 205A with respect to the developer conveying direction. And the supply developer is conveyed to the circulating passage in the developer container 201 by the returning blade portion 2052.

Further, in the embodiment, a constitution, in which the discharging passage 213 and the discharging portion 208 which discharge the excess developer are arranged in a downstream side of the mixing screw 206 with respect to the developer conveying direction, is described. However, similar to the fifth embodiment, these may be arranged in a downstream side of the developing chamber 215 with respect to the developer conveying direction. In this case, as shown in FIG. 19, the returning blade portion 2052 which possesses the conveying force in the opposite direction (direction of arrow Kb) to the developer conveying direction (direction of arrow Ka) in the downstream side of the conveying screw 205 with respect to the developer conveying direction, is provided.

When supply of the supply developer is repeated, the excess developer climbs over the returning blade portion 2052 in the downstream side of the developing chamber 215, flows into the discharging passage 213 and is discharged from the discharging port. Thus, the developer is replaced automatically and gradually.

Further, in a case that the discharging passage 213 is provided in the downstream side of the developing chamber 215 with respect to the developer conveying direction, similar to FIG. 21, it is desirable to provide the developer supplying port 217 in the upstream side of the mixing screw 206 in the mixing chamber 216 with respect to the developer conveying direction. This is because it is possible to sufficiently mix the developer in the developer container 201 and the supply developer which is newly supplied until lifting up the developer to the surface of the developing sleeve 203. In the developing device of the developer automatic replacement method with such the constitution, in order to discharge the developer during replacing, the shielding member 211 shields the first opening portion 207*a* which is closer to the discharging port 208. Thus, the insertion opening 210*a* of the shielding member 211 may be arranged substantially above the first opening portion 207*a*. Other details are also similar to the fifth embodiment.

OTHER EMBODIMENT

In each of the embodiments described above, the supply of the developer to the developing sleeve 203 in the developing chamber 215 as the first chamber and the constitution which collects the developer from the developing sleeve 203 are described. However, the present invention is also possible to apply to a generally known developing device of a function separate type, which supplies the developer to the developing sleeve 203 in the developing chamber 215 as the first chamber and collects the developer from the developing sleeve 203 in the mixing chamber 216 as the second chamber.

Further, the present invention is not limited to a tandem type image forming apparatus 1 using an intermediary transfer method, but may also be an image forming apparatus of other methods. Further, it is not limited to full color, but it may also be monochrome or mono color. Or it may be implemented in various applications such as a printer, various types of printing machines, a copying machine, a fax machine, a multifunction machine, etc.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2021-064899 filed on Apr. 6, 2021, which is hereby incorporated by reference herein in its entirety.

What is claimed is:

1. A developer discharging method of a developing device including, a developer carrying member configured to carry and feed a developer, containing toner and a carrier, to a developing position, a developer container including a first chamber configured to accommodate the developer to be supplied to the developer carrying member, and a second chamber partitioned from the first chamber by a partition wall, the developer being circulated between the first chamber and the second chamber, a first communication portion configured to permit the developer to communicate from the first chamber to the second chamber, a second communication portion configured to permit the developer to communicate from the second chamber to the first chamber, a first feeding screw provided in the first chamber and configured to feed the developer with respect to a first direction from the second communication portion toward the first communication portion, a second feeding screw provided in sthe second chamber and configured to feed the developer with respect to a second direction from the first communication portion toward the second communication portion, and a developer discharging portion provided in a passage continuous with the second chamber of a downstream side of the second communication portion with respect to the second direction and configured to discharge the developer from the developing device, the developer discharging method comprising:

inserting a Ghicld shielding member into the second communication portion via an inserting opening of the developer container to shift the second communication portion from an opening state for opening the second communication portion to a shielding state for shielding the second communication portion; and discharging the developer from the developing device via the developer discharging portion by rotatably driving the first feeding screw in a same direction as a direction of rotatably driving the first feeding screw during a developing operation of developing an electrostatic image formed on an image bearing member in a state in which the shielding member is inserted into the second communication portion, and by rotatably driving the second feeding screw in a same direction as a direction of rotatably driving the second feeding screw during the developing operation in the state in which the shielding member is inserted into the second communication portion.

2. A developer discharging method of a developing device according to claim 1, wherein in discharging the developer from the developing device, the first feeding screw rotatably drives in the same direction at the same speed as a driving speed of the first feeding screw at which the first feeding screw is rotatably driven during the developing operation, and the second feeding screw rotatably drives in the same direction at the same speed as a driving speed of the second feeding screw at which the second feeding screw is rotatably driven during the developing operation.

3. A developer discharging method of a developing device according to claim 1, wherein in discharging the developer from the developer device, in a first period, the first feeding screw rotatably drives in the same direction at a speed slower than a driving speed of the first feeding screw at which the first feeding screw is rotatably driven during the developing operation, and the second feeding screw rotatably drives in the same direction at a speed slower than a driving speed of the second feeding screw at which the second feeding screw is rotatably driven during the developing operation, and in a second period following the first period, the first feeding screw rotatably drives in the same direction at the same speed as a driving speed of the first feeding screw at which the first feeding screw is rotatably driven during the developing operation, and the second feeding screw rotatably drives in the same direction at the same speed as a driving speed of the second feeding screw at which the second feeding screw is rotatably driven during the developing operation.

4. A developing device comprising:

a developer carrying member configured to carry and feed a developer, containing toner and a carrier, to a developing position;

a developer container including a first chamber configured to accommodate the developer to be supplied to said developer carrying member, and a second chamber partitioned from said first chamber by a partition wall, the developer being circulated between said first chamber and said second chamber;

a first communication portion configured to permit the developer to communicate from said first chamber to said second chamber;

a second communication portion configured to permit the developer to communicate from said second chamber to said first chamber;

a first feeding screw provided in said first chamber and configured to feed the developer with respect to a first direction from said second communication portion toward said first communication portion;

a second feeding screw provided in said second chamber and configured to feed the developer with respect to a second direction from said first communication portion toward said second communication portion; and a developer discharging portion provided in a passage continuous with said second chamber of a downstream side of said second communication portion with respect to the second direction and configured to discharge the developer from said developing device, wherein said developer container is provided with an inserting opening into which a shielding member is to be inserted, said shielding member causing said second communication portion to shift from an opening state for opening said second communication portion to a shielding state for shielding said second communication portion.

5. A developing device according to claim 4, wherein said developer container is provided with a cover configured to cover above said first chamber and said second chamber, respectively, and wherein said inserting opening is provided in said cover.

6. A developing device according to claim 5, wherein said shielding member includes an engaging portion configured to engage an inner surface of said cover in a state in which said shielding member is inserted into said second communication portion via said inserting opening.

* * * * *